US008567315B2

(12) United States Patent
Takahashi et al.

(10) Patent No.: US 8,567,315 B2
(45) Date of Patent: Oct. 29, 2013

(54) PLATE SUPPLY AND DISCHARGE DEVICE AND PRINTING PLATE FORMING DEVICE USING SAME

(75) Inventors: Kazuaki Takahashi, Tokyo (JP); Hajime Moriwaki, Tokyo (JP); Masakatsu Kaneyasu, Tokyo (JP); Terumasa Takahashi, Tokyo (JP); Hiroyuki Anzai, Tokyo (JP); Hiroshi Kobayashi, Tokyo (JP); Toshifumi Ono, Tokyo (JP)

(73) Assignee: NEC Engineering, Ltd., Tokyo (JP)

( * ) Notice: Subject to any disclaimer, the term of this patent is extended or adjusted under 35 U.S.C. 154(b) by 784 days.

(21) Appl. No.: 12/672,857

(22) PCT Filed: Aug. 13, 2008

(86) PCT No.: PCT/JP2008/064554

§ 371 (c)(1),
(2), (4) Date: Feb. 9, 2010

(87) PCT Pub. No.: WO2009/025228

PCT Pub. Date: Feb. 26, 2009

(65) Prior Publication Data

US 2011/0041717 A1 Feb. 24, 2011

(30) Foreign Application Priority Data

Aug. 20, 2007 (JP) ..... 2007-213420
Nov. 2, 2007 (JP) ..... 2007-285641

(51) Int. Cl.
*B65H 5/22* (2006.01)
*B41C 1/00* (2006.01)

(52) U.S. Cl.
USPC ..... 101/477; 271/195

(58) Field of Classification Search
USPC ..... 101/389.1, 477; 271/194, 195
See application file for complete search history.

(56) References Cited

U.S. PATENT DOCUMENTS

| | | | | |
|---|---|---|---|---|
| 5,927,203 | A * | 7/1999 | Gieser et al. | 101/419 |
| 6,112,663 | A * | 9/2000 | Ulrich et al. | 101/389.1 |
| 7,464,929 | B2 * | 12/2008 | Hachmann | 271/194 |
| 2003/0106448 | A1 * | 6/2003 | Uemura | 101/477 |

FOREIGN PATENT DOCUMENTS

| | | | |
|---|---|---|---|
| JP | 58-83854 | A | 5/1983 |
| JP | 4-166845 | A | 6/1992 |
| JP | 6-35204 | A | 2/1994 |
| JP | 2825805 | A | 9/1998 |
| JP | 2003-252460 | A | 9/2003 |
| JP | 3569157 | A | 6/2004 |

OTHER PUBLICATIONS

International Search Report for PCT/JP2008/064554, mailed Oct. 21, 2008.

* cited by examiner

*Primary Examiner* — Leslie J Evanisko

(57) ABSTRACT

To provide a plate supply and discharge device and a printing plate forming device which are capable of transferring plates and printing plates of various sizes and preventing the plates and printing plates from being damaged in the plate supply and discharge device (printing plate forming device). A plate supply and discharge unit (4) which supplies a plate (P1) to a drawing unit (3), receives a printing plate P2, which is obtained by drawing an image on the plate P1, from the drawing unit (3), and delivers it to a processor. The plate supply and discharge unit includes a plate supply table (41) for allowing the plate (P1) to float at atmospheric pressure, moves the plate (P1) in a state of being allowed to float at atmospheric pressure above the plate supply table (41), and supplies it to the drawing unit (3).

15 Claims, 25 Drawing Sheets

◎ : ATMOSPHERIC PRESSURE FLOTATION NOZZLE 42e

△ : THIRD AIRFLOW TRANSFER NOZZLE 42g (↑DIRECTION)

◁ : FOURTH AIRFLOW TRANSFER NOZZLE 42i (←DIRECTION)

▽ : FIFTH AIRFLOW TRANSFER NOZZLE 42k (↓DIRECTION)

○ : SUCTION NOZZLE 42n

| | FIRST | SECOND | THIRD | FORUTH | FIFTH | SIXTH | SEVENTH | EIGHTH | |
|---|---|---|---|---|---|---|---|---|---|
| ① | PICK | PICK | | | | | | | FIRST PRINTING |
| ② | | | | | | | | | |
| ③ | | | | | | | | | |
| ④ | A | A | | | | | | | |
| ⑤ | A | A | | | | | | | |
| ⑥ | B | B | | | | | | | |
| ⑦ | DRAWING | DRAWING | PICK | PICK | | | | | |
| ⑧ | | | | | | | | | |
| ⑨ | | | | | | | | | |
| ⑩ | | | A | A | | | | | |
| ⑪ | C | C | A | A | | | | | |
| ⑫ | D | D | B | B | | | | | |
| ⑬ | | | DRAWING | DRAWING | PICK | PICK | | | CYCLE TIME |
| ⑭ | | | | | | | | | |
| ⑮ | | | | | | | | | |
| ⑯ | | | | | A | A | | | |
| ⑰ | | | C | C | STANDBY | STANDBY | | | |
| ⑱ | | | D | D | PLATE SUPPLY | PLATE SUPPLY | | | |
| ⑲ | | | | | WINDING | WINDING | PICK | PICK | |
| ⑳ | | | | | DRAWING | DRAWING | | | |
| ・・・ | | | | | ・・・ | ・・・ | ・・・ | ・・・ | |

Fig. 9

(A) :ON PLATE SUPPLY TABLE (B) :PLATE SUPPLY AND WINDING (C) :DISCHARGE ONTO PLATE DISCHARGE TABLE (D) :DISCHARGE BY AIRFLOW TRANSFER

PLATE SUPPLY AND DISCHARGE DEVICE AND PRINTING PLATE FORMING DEVICE USING SAME

This application is the National Phase of PCT/JP2008/064554, filed on Aug. 13, 2008, which is based upon and claims the benefit of priority from Japanese patent application No. 2007-213420, filed on Aug. 20, 2007, and Japanese patent application No. 2007-285641, filed on Nov. 2, 2007, the disclosure of which is incorporated herein in its entirety by reference.

TECHNICAL FIELD

The present invention relates to a plate supply and discharge device and a printing plate forming device. In particular, the present invention relates to a plate supply and discharge device and a printing plate forming device which supply a plate for forming a printing plate to a drawing unit, receive the printing plate having an image drawn thereon from the drawing unit, and deliver it outside.

BACKGROUND ART

In the field of printing such as newspaper printing and magazine printing, image data produced through editing operation is subjected to RIP (Raster-Image-Processing) to generate binary data, and the binary data is recorded on a plate made of aluminum, thereby forming a plate for printing (printing plate). In forming the printing plate, a CTP (Computer-To-Plate) system for drawing an image directly on a plate without using a film or the like has been recently employed. In this CTP system, a CTP plate (hereinafter referred to simply as "plate") coated with a photosensitizer is used as a plate, and a modulated laser beam is irradiated on the surface of the plate according to the binary data, thereby forming the printing plate.

Incidentally, when images are drawn on plates of various sizes or when images are consecutively drawn on a large number of plates, for example, the above-mentioned printing plate forming device is preferably structured such that multiple cassettes for accommodating plates are installed and necessary plates are automatically supplied therefrom to the printing plate forming device. In this case, however, it is necessary to install multiple supply devices for supplying the cassettes and to connect them to the printing plate forming device. This causes such problems that a large installation area is required and the structure of the device is complicated.

Therefore, as disclosed in Patent Document 1, there has been proposed a plate supply device including: a multiple cassette unit which has multiple cassettes disposed in multiple stages and which selects, from among them, and delivers a cassette for storing plates necessary for forming a printing plate; and an auto loader unit which receives the delivered cassette, ejects the plates one by one from the received cassette, and supplies them to a printing plate forming device.

Further, Patent Document 2 discloses a plate supply device including: a plate handler which has multiple cassettes disposed in multiple stages and includes an elevator mechanism for allowing the cassettes to independently ascend or descend; and a picker which horizontally moves between the plate handler and an imaging engine, ejects plates from the cassettes, and supplies them to the imaging engine. This plate supply device is structured such that a part of the cassettes are allowed to ascend to thereby form a space in an upper portion of a cassette for storing necessary plates, and then the picker is moved horizontally into the space and positioned in the upper portion of the cassette, thereby ejecting the plates.

According to these plate supply devices, plates can be supplied from multiple cassettes simply by installing a single supply device. This enables downsizing of the device and simplification of the structure of the device.

[Patent Document 1] Japanese Patent No. 3569157

[Patent Document 2] Japanese Patent No. 2825805

DISCLOSURE OF INVENTION

Technical Problem

As described above, according to the plate supply devices disclosed in Patent Documents 1 and 2, downsizing of the device can be achieved, for example. However, these devices are structured to transfer plates in a curved state when the plates are transferred from the plate supply device to the printing plate forming device, so the devices have problems in that it is impossible to transfer plates whose length in the transfer direction is short, and that the plates which can be handled are limited.

Further, in the above-mentioned plate supply devices, plates are inserted between a pair of rollers and the rollers guide and transfer the plates. Accordingly, there is another problem in that the rollers come into contact with the plates during the transfer and the plates are damaged, for example.

Furthermore, in the above-mentioned plate supply devices, printing plates are transferred in a curved state or transferred by being guided by the rollers, even in the case of discharging and transferring the printing plates formed in the printing plate supply device. Accordingly, there is a problem in that the sizes of the printing plates that can be transferred are limited and the finished printing plates are damaged, for example.

Therefore, the present invention has been made in view of the above-mentioned problems inherent in the prior art, and has an object to provide a plate supply and discharge device and a printing plate forming device which are capable of transferring plates and printing plates of various sizes and preventing the plates and printing plates from being damaged.

Technical Solution

In order to achieve the above-mentioned object, according to a first aspect of the present invention, there is provided a plate supply and discharge device which supplies a plate to a drawing unit, receives a printing plate having an image drawn thereon from the drawing unit, and delivers the printing plate outside, the plate supply and discharge device including a table that allows the plate to float at atmospheric pressure, characterized in that the plate in a state of being allowed to float at atmospheric pressure is moved above the table and supplied to the drawing unit.

Further, in other to achieve the above-mentioned object, according to a second aspect of the present invention, there is provided a printing plate forming device characterized by supplying a plate from a plate supply and discharge device according to the first aspect of the present invention to a drawing unit, forming a printing plate by drawing an image on the plate in the drawing unit, and delivering the printing plate outside through the plate supply and discharge device.

Advantageous Effects

According to the present invention, it is possible to provide a plate supply and discharge device and a printing plate forming device which are capable of transferring plates and printing plates of various sizes and preventing the plates and printing plates from being damaged.

BEST MODES FOR CARRYING OUT THE INVENTION

FIG. 1A shows a longitudinal section of a plate supply and discharge unit 4 which is a plate supply and discharge device according to the present invention. The upper direction of the drawing corresponds to the upper direction of the device. The plate supply and discharge unit 4 is a plate supply and discharge device which supplies a plate P1 to a drawing unit 3, receives a printing plate P2, which is obtained by drawing an image on the plate P1, from the drawing unit 3, and delivers it outside. The plate supply and display unit 4 includes a plate supply table 41 for allowing the plate P1 to float at atmospheric pressure, and is characterized in that the plate P1 in a state of being allowed to float at atmospheric pressure is moved above the plate supply table 41 and supplied to the drawing unit 3. Note that, as shown in FIG. 1B, a printing plate forming device 1 supplies the plate P1 from the plate supply and discharge unit 4 to the drawing unit 3 to form the printing plate P2 by drawing an image on the plate P1 in the drawing unit 3, and delivers the printing plate P2 outside through the plate supply and discharge unit 4.

Next, an exemplary embodiment of the present invention will be described in detail with reference to the drawings.

As shown in FIG. 2, the printing plate forming device 1 according to this exemplary embodiment is roughly composed of: a skid storage unit 2 that stores skids 20*a* and 20*b*; the drawing unit 3 that forms a printing plate by drawing an image on the plate P1 which is wound around a rotary drum 30; the plate supply and discharge unit 4 that supplies the plate P1 to the drawing unit 3 and delivers the printing plate formed by the drawing unit 3; a conveyer 5 that conveys the printing plate delivered from the plate supply and discharge unit 4 to a processor; and an electrical unit 6 which is provided with a touch panel 60, a control device, and the like.

The skid storage unit 2 is disposed adjacent to the plate supply and discharge unit 4, and as shown in FIG. 2C, a placement section 21 in which the skids 20*a* and 20*b* are placed is provided on a bottom portion thereof. At an upper portion of the skid storage unit 2, there is located an ejection unit 22 which is structured to be vertically movable and ejects the plate P1 from the skids 20*a* and 20*b*.

The ejection unit 22 includes: a guide rail 23 which is structured to be telescopically extendable to the plate supply and discharge unit 4; an ejection table which is disposed below the guide rail 23 and moves horizontally along the guide rail 23; first arms 25 which join the guide rail 23 to an ejection table 24 and is structured to be telescopically extendable in the vertical direction; multiple suction pads 26 which are disposed below the ejection table 24; and second arms 27 which join the ejection table 24 to each of the suction pads 26 and is structured to be telescopically extendable in the vertical direction.

The plate supply and discharge unit 4 is disposed adjacent to the drawing unit 3, and as shown in FIG. 3, there are located, at substantially a central portion thereof, a plate supply table 41 which supplies the plate P1 to the drawing unit 3, and a plate discharge table 42 which is disposed below the plate supply table 41 and receives the printing plate discharged from the drawing unit 3. Each of the plate supply table 41 and the plate discharge table 42 has a flat-plate shape, and the surface size thereof is slightly larger than a 2W2L-size plate P1.

The plate supply table 41 is composed of: a table body 41*a*; a top board 41*b* disposed on the table body 41*a*; and a tilt mechanism 41*c* that tilts the plate supply table 41 to a predetermined angle. As shown in FIG. 4, the top board 41*b* is provided with plate detection sensors 41*d* that detect the presence or absence of the plate P1, and with multiple nozzle units 41*e*.

As shown in FIG. 5, the multiple nozzle units 41*e* are composed of: atmospheric pressure flotation nozzles 41*f* that allow the plate P1 to float at atmospheric pressure; first airflow transfer nozzles 41*h* that blow air toward the plate P1 at a predetermined angle to thereby move the plate P1 to the back side (upward of the drawing); second airflow transfer nozzles 41*j* that blow air toward the plate P1 to thereby move it to the front side (downward of the drawing); and suction nozzles 41*m* that introduce air to suck the plate P1.

The multiple atmospheric pressure flotation nozzles 41*f* are provided in the top board 41*b* and are each disposed on a first pipe 41*g*, which has a comb shape extending in the longitudinal direction of the top board 41*b*, and are grouped together as a flotation nozzle group. The first pipe 41*g* is connected with a solenoid valve (not shown). By controlling opening and closing of the solenoid valve, ON/OFF of all the atmospheric pressure flotation nozzles 41*f*, which are disposed on the first pipe 41*g*, can be collectively switched.

Likewise, the first and second airflow transfer nozzles 41*h* and 41*j* are disposed on second and third pipes 41*i* and 41*k*, respectively, and are grouped together as a transfer nozzle group. Note that the first and second airflow transfer nozzles 41*h* and 41*j* are alternately arranged so that air blowing directions of nozzles adjacent to each other in the lateral direction of the top board 41*b* do not coincide with each other, in order to apply a moving pressure to the entire plate P1 evenly and to move the plate P1 in a good posture.

Further, the second and third pipes 41*i* and 41*k* are divided into back-side pipes 41*i*(*a*) and 41*k*(a) and front-side pipes 41*i*(*b*) and 41*k*(b). The pipes are respectively connected with separate solenoid valves. This makes it possible to independently drive the airflow transfer nozzles 41*h*(a) and 41*j*(*a*) disposed on the back-side pipes and the airflow transfer nozzles 41*h*(b) and 41*j*(*b*) disposed on the front-side pipes.

Furthermore, the suction nozzles 41*m* are disposed on fourth pipes 41*n* and grouped together in a similar manner as the other nozzles. The multiple fourth pipes 41*n* are provided in the top board 41*b*, and are respectively provided with separate solenoid valves.

Returning to FIG. 4, first positioning guides 41*p* and a first positioning sensor 41*q* are provided at substantially a central portion of the top board 41*b*, and second positioning guides 41*r* and a second positioning sensor 41*s* are provided at a long side portion on one side of the top board 41*b*. Each of the first and second positioning guides 41*p* and 41*r* extends along the longitudinal direction of the top board 41*b*, is structured to be movable up and down, and is movable on the surface and movable in and out of the top board 41*b*. The first and second positioning sensors 41*q* and 41*s* act to detect the presence or absence of the plate P1, and are disposed near the first and second positioning guides 41*p* and 41*r*, respectively.

Furthermore, at a short side portion on the drawing unit 3 side of the top board 41*b*, there are provided pre-insertion reference guides 41*t* which extend along the lateral direction of the top board 41*b*, and insertion position determining sensors 41*u* which are disposed near the pre-insertion reference guides 41*t*. Between the pre-insertion reference guides 41*t* and the first and second positioning guides 41*p* and 41*r*, rockable positioning guides 41*v* for temporarily regulating the posture of the plate P1 are provided. Note that, like the first and second positioning guides 41*p* and 41*r*, the pre-insertion reference guides 41*t* and the rockable positioning guides 41*v* are also structured to be movable in and out of the top board 41*b*.

Further, the table body 41*a* (see FIG. 3) is connected with an air pump, which is not shown, or the like, and air from the air pump is supplied to the nozzle units 41*e* of the top board 41*b* through the table body 41*a*.

As shown in FIG. 3, like the plate supply table 41, the plate discharge table 42 includes a table body 42*a* and a top board 42*b* which is disposed on the table body 42*a*. Note that the plate discharge table 42 is provided with no tilt mechanism, and the plate discharge table 42 is located in a state of being fixed at a horizontal angle.

As shown in FIG. 6, the top board 42*b* is provided with plate detection sensors 42*c* and multiple nozzle units 42*d*. Further, a step is formed along one long side and one short side of the top board 42*b*, thereby forming a guide block 42*q* which has an L-shape when viewed from the top.

As shown in FIG. 7, the nozzle units 42*d* are composed of: atmospheric pressure flotation nozzles 42*e* that allow the printing plate to float at atmospheric pressure; third airflow transfer nozzles 42*g* that move the printing plate to the back side (upward of the drawing); fourth airflow transfer nozzles 42*i* that move the printing plate to the opposite side of the drawing unit 3 (leftward of the drawing); fifth airflow transfer nozzles 42*k* that move the printing plate to the front side (downward of the drawing); and nozzles 42*n* that suck the printing plate.

The atmospheric pressure flotation nozzles 42*e* are each disposed on a fifth pipe 42*f*, which has a comb shape extending in the lateral direction of the top board 42*b*, and are grouped together as a flotation nozzle group. Note that, unlike the first pipe 41*g* (see FIG. 5) of the plate supply table 41, the fifth pipe 42*f* is divided into a back-side pipe 42*f*(*a*) and a front-side pipe 42*f*(*b*), and the pipes are respectively connected with separate solenoid valves.

Likewise, the third to fifth airflow transfer nozzles 42*g*, 42*i*, and 42*k* are disposed on sixth to eighth pipes 42*h*, 42*j*, and 42*m*, respectively, and are grouped together as a transfer nozzle group. Note that the third to fifth airflow transfer nozzles 42*g* to 42*k* are alternately disposed in the longitudinal direction of the top board 42*b* so that air blowing directions of adjacent nozzles do not coincide with each other. Further, like the fifth pipe 42*f*, the sixth to eighth pipes 42*h* to 42*m* are divided into back-side pipes 42*h*(*a*) to 42*m*(*a*) and front-side pipes 42*h*(*b*) to 42*m*(*b*), and the pipes are respectively connected with separate solenoid valves.

Likewise, the suction nozzles 42*n* are disposed on ninth pipes 42*p* and grouped together. Like the suction nozzles 41*m* (see FIG. 5) of the plate supply table 41, the multiple ninth pipes 42*p* are provided and the pipes are respectively connected with separate solenoid valves.

Returning to FIG. 6, at a substantially central portion of the top board 42*b*, there are provided a third positioning guide 42*r* which extends along the longitudinal direction of the top board 42*b*. In addition, there are provided fourth positioning guides 42*s* which extend along the lateral direction of the top board 42*b*, so as to be orthogonal to the third positioning guide 42*r*. The third and fourth positioning guides 42*r* and 42*s* are structured to be movable in and out of the top board 42*b*.

Returning to FIG. 3, a placement section 43 in which a skid 44 is placed is provided below the plate discharge table 42. Although not shown, the placement section 43 is provided with a horizontal movement mechanism that moves the skid 44 horizontally, thereby enabling the skid 44 to move above the skids 20*a* and 20*b* as shown in FIG. 2C. Note that FIGS. 2 and 3 illustrate only one stage of the skid 44, but multiple skids 44 may be stored in the placement section 43. In that case, it is preferable that the multiple skids 44 be arranged in multiple stages in the vertical direction and that a skid required for forming a printing plate be allowed to move horizontally from the stages.

Next, a procedure for forming a printing plate using the printing plate forming device having the above-mentioned structure will be described with reference to FIGS. 8 to 30. Herein, a series of operation procedures will be first explained by taking, as an example, the case of handling 1W2L-size plates P1, and then the case of handling plates P1 of other sizes will be explained.

In forming a printing plate, as shown in FIG. 8, the ejection unit 22 first descends to an ejection position from a standby position, and two plates P1 placed on the skids 20*a* and 20*b* are sucked by the suction pads 26 (FIG. 9 (1)). Then, as shown in FIG. 10A, the ejection unit 22 ascends in the state where the plates P1 are sucked (FIG. 9 (2)), and after ascending to the standby position, the guide rail 23 is extended toward the plate supply and discharge unit 4.

Next, as shown in FIG. 11A, the ejection table 24 moves horizontally along the guide rail 23, and moves above the plate supply table 41 (FIG. 9 (3)). Then, as shown in FIG. 12A, the first and second arms 25 and 27 are extended downward to allow the plates P1 to descend to a release position, and the suction of the suction pads 26 is released to place the plates P1 on the plate supply table 41 (FIG. 9 (4)). Note that the plates P1 are placed in such a manner that the two plates P1 are arranged in a direction orthogonal to a plate supply direction (arrow direction of FIG. 13A) and placed as shown in FIG. 13A.

In this case, the atmospheric pressure flotation nozzles 41*f* (see FIG. 5) are driven so that air is blown out of the surface of the plate supply table 41. The plates 1 are maintained in the state of floating slightly at atmospheric pressure, and the plates 1 are moved and positioned. In positioning the plates P1, as shown in FIG. 14, the first positioning guides 41*p* and the rockable positioning guides 41*v*, which are disposed on the plate supply table 41, first ascend and project from the surface of the top board 41*b*. Note that the first positioning guides 41*p* and the rockable positioning guides 41*v* may project at a timing when the plates P1 are allowed to descend to the release position, or at the previous timing.

After that, the back-side second airflow transfer nozzles 41*j*(*a*) and the front-side first airflow transfer nozzles 41*h*(*b*) (see FIG. 5) are driven in the state where the plates P1 are allowed to float at atmospheric pressure above the top board 41*b*, and the plates P1 are transferred toward the first positioning guides 41*p* by airflow. Then, the plates P1 are aligned to the first positioning guide 41*p* side until the plates P1 are detected by the first positioning sensor 41*q*. At the time when the plates P1 are moved to a predetermined position, the suction nozzles 41*m* (see FIG. 5) are driven to suck the plates P1.

In this manner, the airflow transfer nozzles 41*h* and 41*j* are provided aside from the atmospheric pressure flotation nozzles 41*f*, and the plates are moved only by air without using an extrusion member or the like, thereby making it possible to appropriately prevent the plates P1 from being damaged. In addition, in the case where the airflow transfer nozzles 41*h* and 41*j* are provided, the number of components of the plate supply table 41 and the number of consumable components can be reduced, which can also lead to a reduction in device cost and maintenance cost.

Further, the first positioning guides 41*p* are provided only on one side of the plates P1 and the positioning is carried out while the plates P1 are transferred by airflow toward the first positioning guides 41*p*. Accordingly, only one long side of each plate P1 comes into contact with the first positioning guides 41*p* and no other portions of the plate P1 come into contact with other members. Thus, the positioning of the plates P1 can be carried out in the state where the area and frequency of contact with other members are small. This makes it possible to prevent the plates P1 from being damaged during the positioning.

Thus, when the positioning of the plates P1 is completed, as shown in FIG. 15A, the ejection table 24 moves horizontally to the skid storage unit 2 side, and the guide rail 23 contracts and the ejection unit 22 returns to the standby state (state shown in FIG. 2) (FIG. 9 (5)). Then, as shown in FIG. 16B, the tilt mechanism 41*c* (see FIG. 3) of the plate supply table 41 is driven to tilt the plate supply table 41 toward the drawing unit 3. In this case, the pre-insertion reference guides 41*t* (see FIG. 14), which are disposed on the plate supply table 41, are allowed to ascend and project above the top board 41*b*, and the rockable positioning guides 41*v* are allowed to descend and stored in the top board 41*b*, thereby moving the plates P1 to the front side of the pre-insertion reference guides 41*t*.

After that, in accordance with the operation of the rotary drum 30 of the drawing unit 3, the pre-insertion reference guides 41*t* are stored in the top board 41*b* and the suction of the plates P1 is released. As a result, the plates P1 placed on the plate supply table 41 slide on the top board 41*b* by their own weights and are dropped to the drawing unit 3 side along the slope, whereby the plates P1 are supplied to the rotary drum 30 (FIG. 9 (6)).

In this manner, the plates P1 in the state of being allowed to float at atmospheric pressure are moved above the plate supply table 41 having a flat plate shape and are supplied to the rotary drum 30. Accordingly, the plates P1 can be transferred to the rotary drum 30 while the plates P1 are prevented from being curved and are kept in the posture where the plates P1 are placed on the plate supply table 41. Thus, the plates P1 can be supplied and transferred regardless of the length in the transfer direction of the plates P1. This makes it possible to eliminate limitations on the plates P1 that can be transferred, and to handle the plates P1 of various sizes.

Further, the plates P1 in the state of being allowed to float at atmospheric pressure are moved, thereby making it possible to avoid the plates P1 from coming into contact with other members until the plates P1 reach a plate supply port of the rotary drum 30, and to prevent the plates P1 from being damaged.

Furthermore, air is utilized for the flotation and transfer of the plates P1, thereby eliminating the need for mounting a roller or a conveyer to the plate supply table 41, and enabling formation of the plate supply table 41 with a small thickness.

Therefore, in comparison with the case of conveyer transportation or the like, space saving can be achieved, and the plate supply and discharge unit 4 and the printing plate forming device 1 can be downsized as a whole. Further, the number of components of the table can be reduced, which can also lead to a reduction in the number of components.

Furthermore, the plates P1 are transferred to the rotary drum 30 by tilting the plate supply table 41 and allowing the plates P1 to drop along the slope. This permits the plates P1 to enter the plate supply port of the rotary drum 30 with a certain momentum, and enables the plates P1 to be smoothly supplied to the rotary drum 30. Note that in order to prevent the plates P1 from being damaged due to an impact caused when the plates enter the plate supply port of the rotary drum 30, the inclination angle of the plate supply table 41 is preferably about 10° or smaller.

When the plate P1 is supplied to the rotary drum 30, as shown in FIG. 17B, the rotary drum 30 is rotationally driven clockwise, and the plate P1 is wound around the outer periphery of the rotary drum 30 (FIG. 9 (6)). Then, as shown in FIG. 18B, when the entirety of the plate P1 is wound around the rotary drum 30, the plate P1 is irradiated with a laser beam, and a drawing process for the plate P1 is started (FIG. 9 (7)). In parallel with this, as shown in FIG. 18A, the ejection unit 22 descends to the ejection position to suck the subsequent plates P1 (third and fourth plates) placed on the skids 20*a* and 20*b*.

Then, as shown in FIG. 19A, the ejection unit 22 ascends to the standby position to allow the subsequent plates P1 to ascend (FIG. 9 (8)). Next, as shown in FIG. 20A, the ejection table 24 moves horizontally to the plate supply and discharge unit 4 side, and thereafter, as shown in FIG. 21A, the ejection table 24 descends to the release position to place the subsequent plates P1 on the plate supply table 41 (FIG. 9 (9), (11)). Note that while the subsequent plates P1 are transferred to the plate supply table 41, the drawing process for the initial plates P1 (first and second plates) is continued on the drawing unit 3 side (FIG. 9 (8)-(10)).

In this manner, the drawing process for the initial plates P1 and the process for placing the subsequent plates P1 on the plate supply table 41 are carried out in parallel. Accordingly, the subsequent plates P1 can be prepared on the plate supply table 41 before the drawing process for the initial plates P1 is finished. Thus, after the drawing process for the initial plates P1 is finished, the subsequent plates P1 can be rapidly supplied to the rotary drum 30 to start the drawing process, and the processing speed for forming the printing plates can be improved.

When the drawing process for the initial plates P1 is finished, as shown in FIG. 22B, the rotary drum 30 is rotationally driven counterclockwise to discharge the printing plates P2, on which images have been drawn, onto the plate discharge table 42 (FIG. 9 (11)). Also at this time, the plate discharge table 42 is supplied with air from an air pump or the like, and air is blown out of the surface of the top board 42*b*. Thus, the printing plates P2 discharged from the rotary drum 30 are maintained in the state of floating slightly at atmospheric pressure from the surface of the top board 42*b*. Also in this case, as shown in FIG. 23, the third positioning guide 42*r* disposed on the plate discharge table 42 ascends and projects above the top board 42*b*, thereby regulating the positions of the printing plates P2 to be discharged. In parallel with this, the fourth and fifth airflow transfer nozzles 42*i*(*a*) and 42*k*(*a*) on the back side and the airflow transfer nozzles 42*g*(*b*) and 42*i*(*b*) on the front side as shown in FIG. 7 are driven, whereby the printing plates P2 are aligned to the third positioning guide 42*r* side and positioned.

Then, when the entirety of the printing plates P2 is discharged, third airflow transfer nozzles 42*g*(*a*) on the back side (see FIG. 7) are driven, and as shown in FIG. 24A, one of the two plates P2 is transferred by airflow toward the conveyer 5 (FIG. 9 (12)). In parallel with this, the plate supply table 41 is tilted, and the subsequent plates P1 placed on the plate supply table 41 are supplied to the rotary drum 30 in a similar manner as shown in FIG. 16B.

In this manner, also at the time of discharging and transferring the printing plates P2, the printing plates P2 are transferred utilizing atmospheric pressure flotation. This makes it possible to transfer the printing plates P2 of various sizes and prevent the printing plates P2 from being damaged, for example, as in the case of supplying and transferring the plates P1. In addition, in positioning the printing plates P2, the printing plates P2 are aligned to the third positioning guide 42*r* side and positioned, thereby making it possible to prevent the printing plates from being damaged during the positioning.

When the first printing plate P2 is delivered to the processor, air is blown against the second printing plate P2 to transfer it by airflow in a similar manner, and is delivered to the processor through the conveyer 5 as shown in FIG. 25A (FIG. 9 (12)). At the same time, the rotary drum 30 is rotationally driven clockwise, and the subsequent plate P1 is wound around the outer periphery of the rotary drum 30 to start the drawing process.

After that, the similar process as described above is repeated to draw an image on the subsequent plate P1, and the drawing process is sequentially carried out for the fifth plate P1 and subsequent plates P1 (FIG. 9 (13) to (20)).

Note that when the plates P1 are picked up from the skid 44 shown in FIG. 2C to draw images thereon, the skid 44 first moves horizontally above the skids 20*a* and 20*b*, and then the ejection unit 22 descends to suck the plates P1 placed in the skid 44. Then, the ejection unit 22 ascends together with the plates P1, and thereafter the process for placement on the plate supply table 41, the process for supplying plates to the drawing unit 3, and the drawing process are sequentially carried out in a similar manner as shown in FIGS. 8 to 25.

Next, a description is given of the case of handling the plate P1 and printing plate P2 of 2W2L-size. Note that also in the case of 2W2L-size, the procedures for sucking the plate P1 and the like are substantially the same as those in the case of 1W2L-size, so the positioning on the plate supply table 41 and the plate discharge table 42 is mainly described herein.

When the 2W2L-size plate P1 is placed on the plate supply table 41, a single plate P1 is placed at the center of the plate supply table 41 as shown in FIG. 13B. At the time of placement on the plate supply table 41, as shown in FIG. 26, the second positioning guides 41*r* project above the top board 41*b*. In this state, the plate P1 is transferred by airflow toward the second positioning guides 41*r*, thereby positioning the plate P1. After that, the plate supply table 41 is tilted to supply the plate P1 to the drawing unit 3 by utilizing its own weight, and the drawing process is carried out in the drawing unit 3.

Meanwhile, in the case of discharging the printing plate P2, as shown in FIG. 27, both the third and fourth positioning guides 42*r* and 42*s* (see FIG. 6) are stored in the top board 42*b*, and the printing plate P2 is transferred by airflow toward the guide block 42*q*. Then, the printing plate P2 is sucked in the state where the printing plate P2 is brought into contact with the guide block 42*q*, thereby positioning the printing plate P2. When the positioning of the printing plate P2 is completed, the suction is released and the third airflow transfer nozzles 42*g* are driven to transfer the printing plate to the conveyer 5 (see FIG. 2).

Subsequently, a description is given of the case of handling the plate P1 and printing plate P2 of 2W1L-size. Note that, also in this case, the positioning on the plate supply table 41 and the plate discharge table 42 is mainly described.

When the 2W1L-size plate P1 is placed on the plate supply table 41, as shown in FIG. 13C, the plate P1 is disposed in parallel with the direction orthogonal to the plate supply direction, and a single plate is placed on the rotary drum 30 side. At the time of placement on the plate supply table 41, as shown in FIG. 28, the second positioning guides 41*r* are allowed to project above the top board 41*b*, and the plate P1 is transferred by airflow toward the second positioning guides 41*r*, thereby positioning the plate P1.

Meanwhile, at the time of discharging the printing plate P2, as shown in FIG. 29, the fourth positioning guides 41*s* project above the top board 42*b*. In this state, the printing plate P2 is transferred by airflow toward the fourth positioning guides 41*s* and the guide block 42*q*. Then, the printing plate P2 is sucked in the state where the printing plate P2 is brought into contact with them, thereby positioning the printing plate P2.

Note that in the case of placing 1W1L-size plates P1, as shown in FIG. 13D, two plates P1 are placed side by side in the direction orthogonal to the plate supply direction. At the time of placement on the plate supply table 41, in a similar manner as in the case of placing the 1W2L-size plates P1 (see FIG. 14), the plates P1 are transferred by airflow toward the first positioning guides 41*p* in the state where the first positioning guides 41*p* are allowed to project above the top board 41*b*, thereby positioning the plates P1.

Meanwhile, at the time of discharging the printing plates P2, as shown in FIG. 30, the printing plates P2 are transferred by airflow toward the third and fourth positioning guides 42*r* and 42*s* in the state where both the third and fourth positioning guides 42*r* and 42*s* are allowed to project above the top board 42*b*, thereby positioning the printing plates P2.

In this manner, the first to fourth positioning guides 41*p* to 41*s* are disposed at different positions depending on the size of the plate P1 and the printing plate P2, and are structured to be movable in and out of the top board 41*b* or the top board 42*b*. Accordingly, the positioning of the plates P1 or the like of various types can be achieved simply by controlling the moving in and out of them depending on the size of the plates P1 or the like to be handled, without any limitation on their size.

Further, since the plates P1 or the like of any size are transferred by airflow toward the positioning guides and positioned, the area and frequency of contact with other members can be reduced and the plates P1 or the like can be prevented from being damaged, as in the case of positioning the 1W2L-size plates P1 or the like.

As described above, the plate supply and discharge unit 4 according to this exemplary embodiment is a plate supply and discharge device which supplies the plate P1 to the drawing unit 3, receives the printing plate P2, which is obtained by drawing an image on the plate P1, from the drawing unit 3, and delivers it outside. The plate supply and discharge unit 4 includes the plate supply table 41 for allowing the plate P1 to float at atmospheric pressure, moves the plate P1 in the state of being allowed to float at atmospheric pressure above the plate supply table 41, and supplies it to the drawing unit 3.

Since the plates P1 in the state of being allowed to float at atmospheric pressure are moved above the table 41, the plates P1 can be transferred to the drawing unit 3 without being curved, and the plates P1 of various sizes can be handled without any limitation on the size of the plates P1 that can be supplied and transferred. Further, it is possible to avoid the plates P1 from coming into contact with other members until the plates reach the drawing unit 3, so the plates P1 can be prevented from being damaged. Furthermore, in comparison with the case of conveyer transportation or the like, the device can be downsized and the number of components can be reduced.

Further, in the plate supply and discharge unit 4, the plate supply table 41 includes the atmospheric pressure flotation nozzles 41*f* for allowing the plates P1 to float at atmospheric pressure, and the airflow transfer nozzles 41*h* and 41*j* for allowing the plate P1 to float at atmospheric pressure, and the plates P1 are moved only by air pressure without using an extrusion member or the like. This makes it possible to appropriately prevent the plates P1 from being damaged. Furthermore, the number of components of the plate supply table 41 and the number of consumable components can be reduced, which can also lead to a reduction in device cost and maintenance cost.

Further, the plate supply and discharge unit 4 is structured to include two or more types of air blowing means having different air blowing directions, such as the airflow transfer nozzles 41*h* and 41*j*. Thus, the plates P1 can be transferred by airflow not only in one direction but also in multiple directions. This makes it possible to increase the degrees of freedom of transfer directions and positioning of the plates P1.

Further, in the plate supply and discharge unit 4, multiple air blowing means having the same air blowing direction are disposed on a single pipe, in at least one of the atmospheric pressure flotation nozzles 41*f* and the airflow transfer nozzles 41*h* and 41*j*. Thus, the air blowing means are grouped together in each air blowing direction, thereby making it possible to collectively control ON/OFF and simplify the switching control.

Further, the plate supply and discharge unit 4 includes the first positioning guides 41*p*, which are disposed on the surface of the plate supply table 41 so as to correspond to one side among the four sides of the plate P1, and transfers the plate P1 by airflow toward the first positioning guides 41*p* to perform positioning of the plate P1 while aligning it to the first positioning guide 41*p*. Thus, the plates P1 can be positioned in the state where the area and frequency of contact with other members are reduced. This makes it possible to prevent the plates P1 from being damaged during the positioning.

Further, in the plate supply and discharge unit 4, multiple plate positioning guides, such as the first positioning guides 41*p* and the second positioning guides 41*r*, are disposed on the surface of the plate supply table 41. The multiple plate positioning guides are disposed at different positions depending on the size of the plates P1 and are structured to be movable on the surface of the plate supply table 41 and movable in and out thereof. Thus, the positioning of the plates P1 of various sizes can be achieved simply by controlling the moving in and out of the plate positioning guides depending on the size of the plates P1 to be handled, without any limitation on the size.

Further, the plate supply and discharge unit 4 includes the plate discharge table 42 for receiving the printing plates P2 discharged from the drawing unit 3 and for allowing the plates to float at atmospheric pressure, moves the printing plates P2 in the state of being allowed to float at atmospheric pressure above the plate discharge table 42, and delivers it outside. This makes it possible to transfer the printing plates P2 of various sizes and prevent the printing plates P2 from being damaged, for example, as in the case of supplying and transferring the plates.

Further, in the plate supply and discharge unit 4, the plate discharge table 42 includes the atmospheric pressure flotation 42*e* for allowing the printing plates P2 to float at atmospheric pressure, and the airflow transfers 42*g*, 42*i*, and 42*k* for transferring the printing plates P2 by airflow. This makes it possible to appropriately prevent the printing plates P2 from being damaged, and to reduce the number of components of the table 42 and the number of consumable components.

Further, the plate supply and discharge unit 4 is structured to include two or more types of air blowing means having different air blowing directions, such as the airflow transfer nozzles 42*g*, 42*j*, and 42*k*. Thus, the printing plates P2 can be transferred by airflow in multiple directions. This makes it possible to increase the degrees of freedom of transfer directions and positioning of the printing plates P2.

Further, in the plate supply and discharge unit 4, multiple air blowing means having the same air blowing direction are disposed on a single pipe, in at least one of the atmospheric pressure flotation nozzles 42*e* and the airflow transfer nozzles 42*g*, 42*i*, and 42*k*. Thus, the air blowing means are grouped together, thereby making it possible to collectively control ON/OFF and simplify the switching control.

Further, the plate supply and discharge unit 4 includes the third positioning guide 42*r*, which is disposed on the surface of the plate discharge table 42 so as to correspond to one side among the four sides of the printing plate P2, and transfers the printing plate P2 by airflow toward the third positioning guide 42*r* to perform positioning of the printing plate P2 while aligning it to the third positioning guide 42*r*. Thus, it is possible to perform positioning of the printing plate P2 while preventing the printing plate P2 from being damaged.

Further, in the plate supply and discharge unit 4, multiple printing plate positioning guides, such as the third positioning guide 42*r* and the fourth positioning guides 41*s*, are disposed on the surface of the plate supply table 42. The multiple printing plate positioning guides are disposed at different positions depending on the size of the printing plates and are structured to be movable on the surface of the plate supply table 42 and movable in and out thereof. Thus, the positioning of the printing plates P2 of various types can be achieved without any limitation on the size.

Further, in the plate supply and discharge unit 4, at least one of the plate supply table 41 and the plate discharge table 42 (plate supply table 41 in the above-mentioned structure) is structured to be tiltable. Accordingly, at least one of the plate P1 and the printing plate P2 (plate P1 in the above-mentioned structure) can be moved utilizing the inclination.

Further, in the plate supply and discharge unit 4, the plate supply table 41 and the plate discharge table 42 are disposed in multiple stages in the vertical direction. Accordingly, space saving can be achieved and the plate supply and discharge device can be downsized.

Further, the plate supply and discharge unit 4 includes the ejection unit 22 for ejecting the plates P1 from the skid 20, which stores the plates P1, and for transferring the plates onto the plate supply table 41. The ejection unit 22 ejects the subsequent plates P1 from the skid 20 and transfers the plates onto the plate supply table 41 while images are drawn on the plates P1 in the drawing unit 3. Thus, before the drawing process for the initial plates P1 is finished, the subsequent plates P1 can be prepared on the plate supply table 41, and the processing speed for forming the printing plates can be improved.

Further, the printing plate forming device 1 according to this exemplary embodiment supplies the plates P1 from the plate supply and discharge unit 4 to the drawing unit 3, forms printing plates by drawing images on the plates P1 in the drawing unit 3, and delivers the printing plates P2 outside through the plate supply and discharge unit 4. This makes it possible to transfer the plates P1 and printing plates P2 of various sizes and to prevent the plates P1 and printing plates P2 from being damaged.

Although exemplary embodiments of the present invention have been described above, the present invention is not limited to the above-mentioned structures and various modifications can be made.

For example, though the plate supply table 41 is structured to be tiltable and the plate discharge table 42 is horizontally fixed and located in the above-mentioned exemplary embodiment, the plate supply table 41 may be horizontally fixed and located and the plate discharge table 42 may be structured to be tiltable. Alternatively, both the plate supply table 41 and the plate discharge table 42 may be structured to be tiltable and the both may be horizontally fixed and located.

Moreover, at the time of supplying the 1W2L-size plates P1 to the drawing unit 3, two plates P1 are simultaneously supplied (see FIG. 16A) in the above-mentioned exemplary embodiment, but the plates may be supplied one by one in a manner as described below, for example. Specifically, as shown in FIG. 14, after the positioning of the two plates P1 is carried out in the state where the first positioning guides 41*p* are allowed to project above the top board 41*b*, only one of the plates P1 is first supplied to the drawing unit 3, and thereafter the first positioning guides 41*p* are stored in the top board 41*b*. Then, the other of the plates P1 is transferred by airflow to the position where one of the plates P1 is placed, and is supplied to the drawing unit 3 alter the first positioning guides 41*p* are allowed to project again and the positioning is carried out. Note that the same is applied to the case of supplying the 1W1L-size plates P1.

Further, though only the skids are illustrated as storage units for storing the plates P1 in the above-mentioned exemplary embodiment, cassettes may be used in place of the skids, and a combination of both the skids and cassettes may also be used.

BRIEF DESCRIPTION OF DRAWINGS

FIG. 9 is a process chart showing the overall procedure of the printing plate forming process;

EXPLANATION OF REFERENCE

Figure 1A:
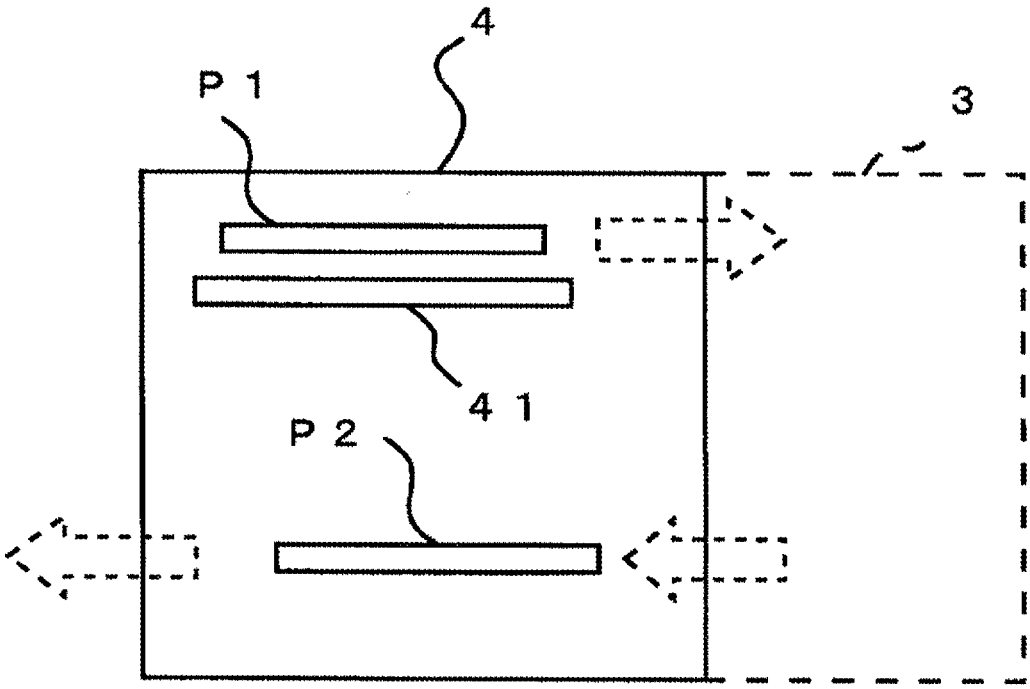
FIG. 1A is a view showing structures of a plate supply and discharge device and a printing plate forming device according to the present invention.
Figure 1B:
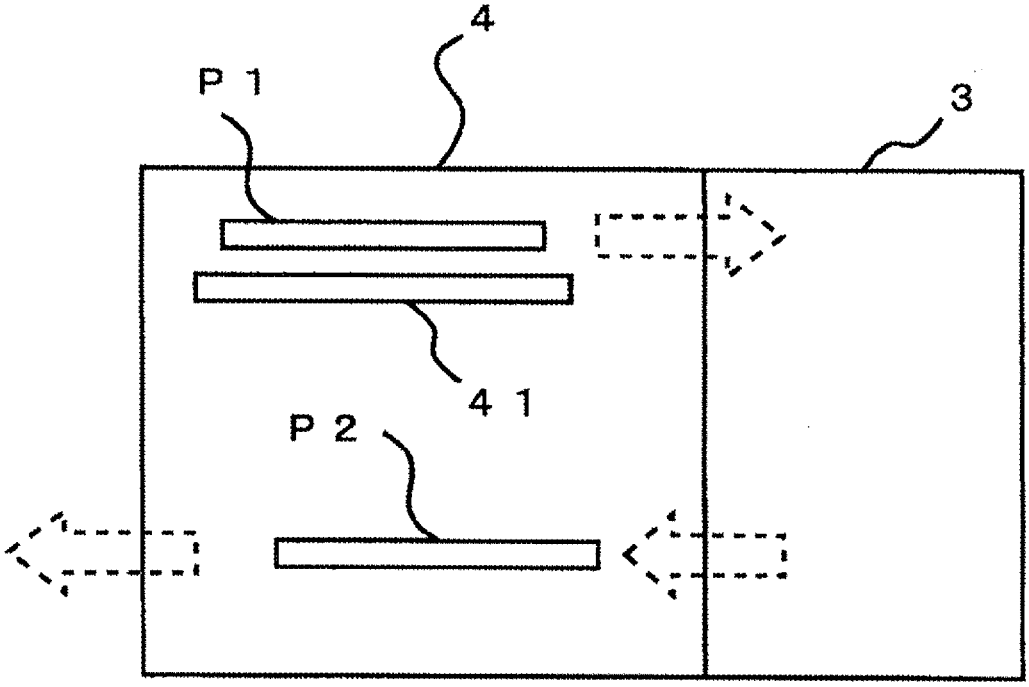
FIG. 1B is a view showing the structures of the plate supply and discharge device and the printing plate forming device according to the present invention.
Figure 2A:
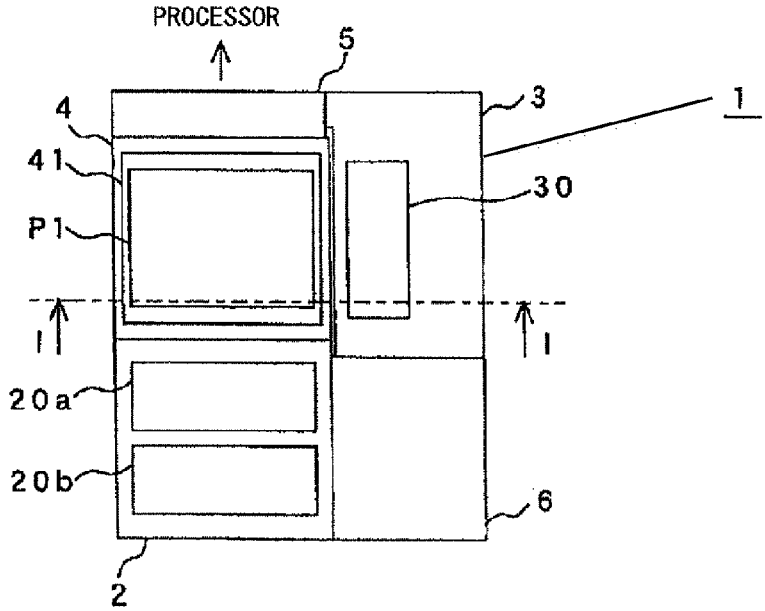
FIG. 2A is a schematic three-view drawing showing an exemplary embodiment of the printing plate forming device according to a preferred embodiment of the present invention.
Figure 2B:
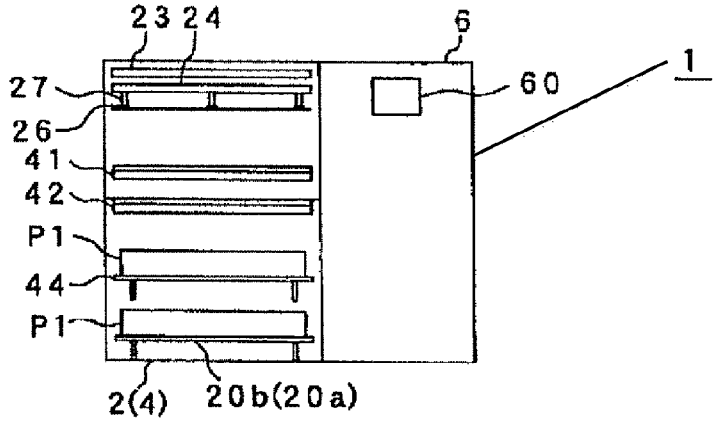
FIG. 2B is a schematic three-view drawing showing an exemplary embodiment of the printing plate forming device according to a preferred embodiment of the present invention.
Figure 2C:
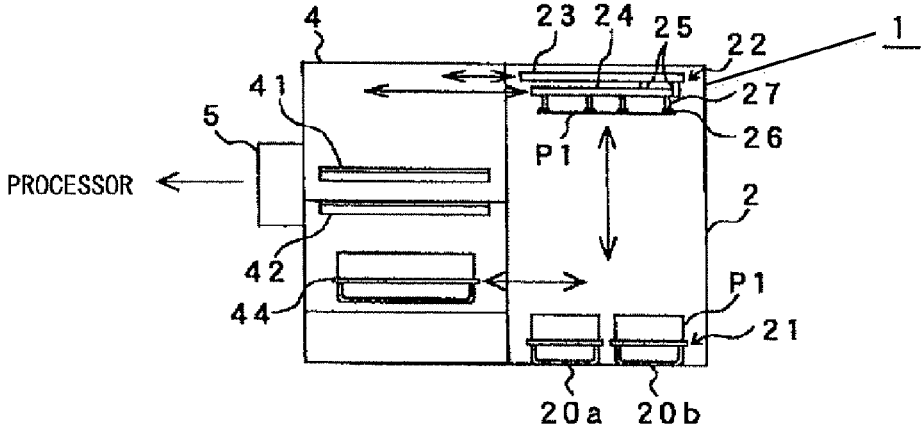
FIG. 2C is a schematic three-view drawing showing an exemplary embodiment of the printing plate forming device according to a preferred embodiment of the present invention.
Figure 3:
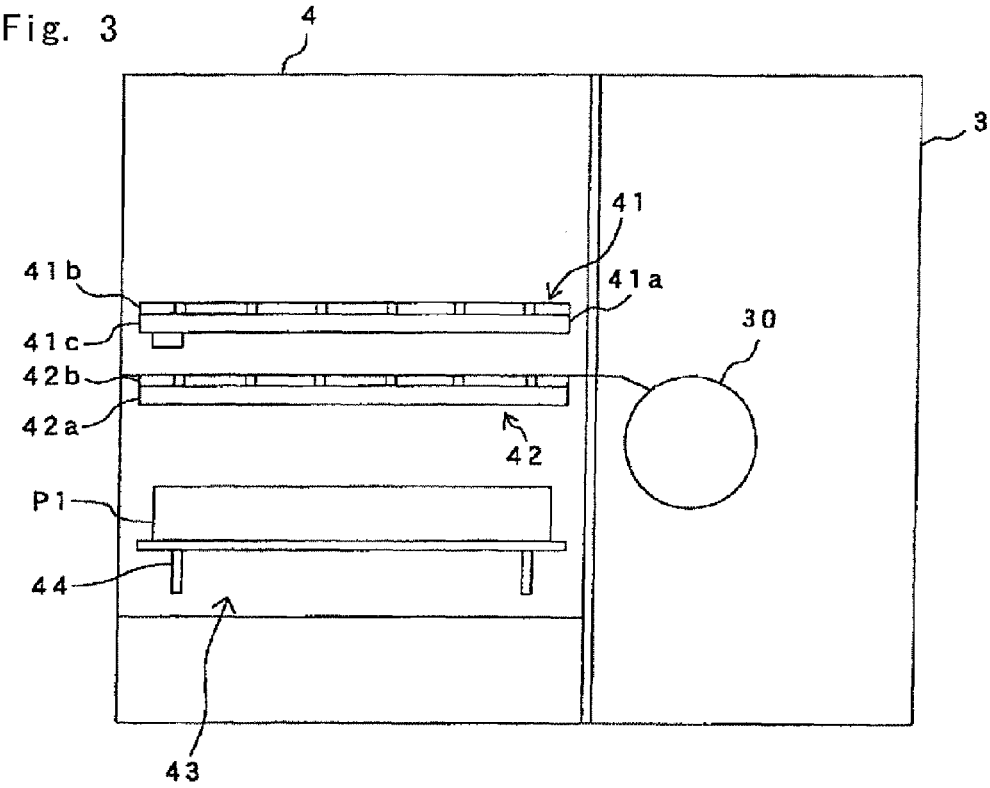
FIG. 3 is a sectional view taken along the line I-I of FIG. 2A.
Figure 4:
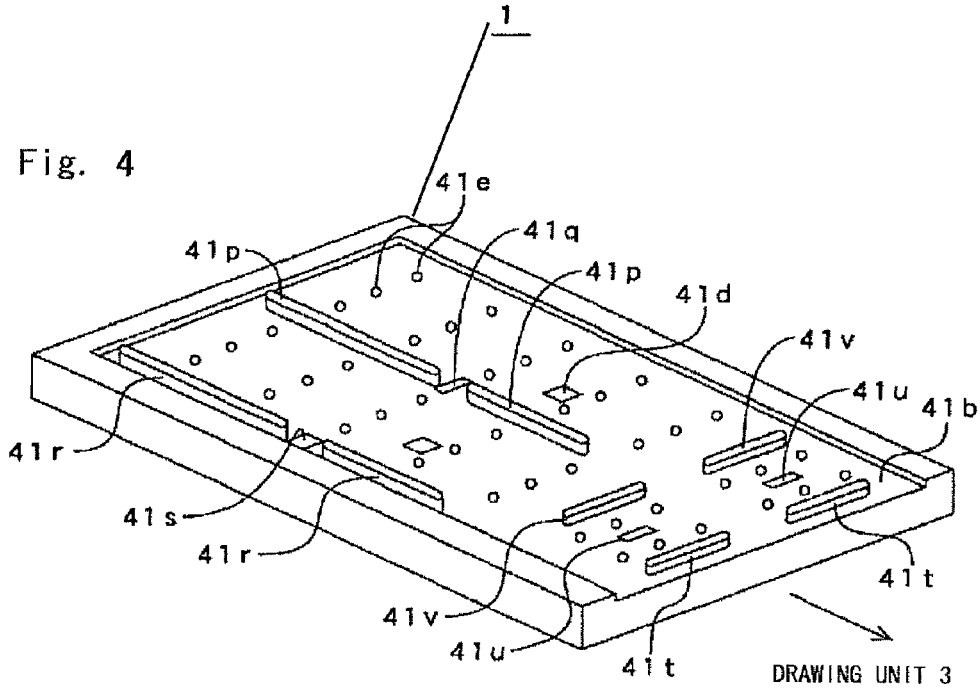
FIG. 4 is a perspective view showing a plate supply table shown in FIG. 3.
Figure 5:
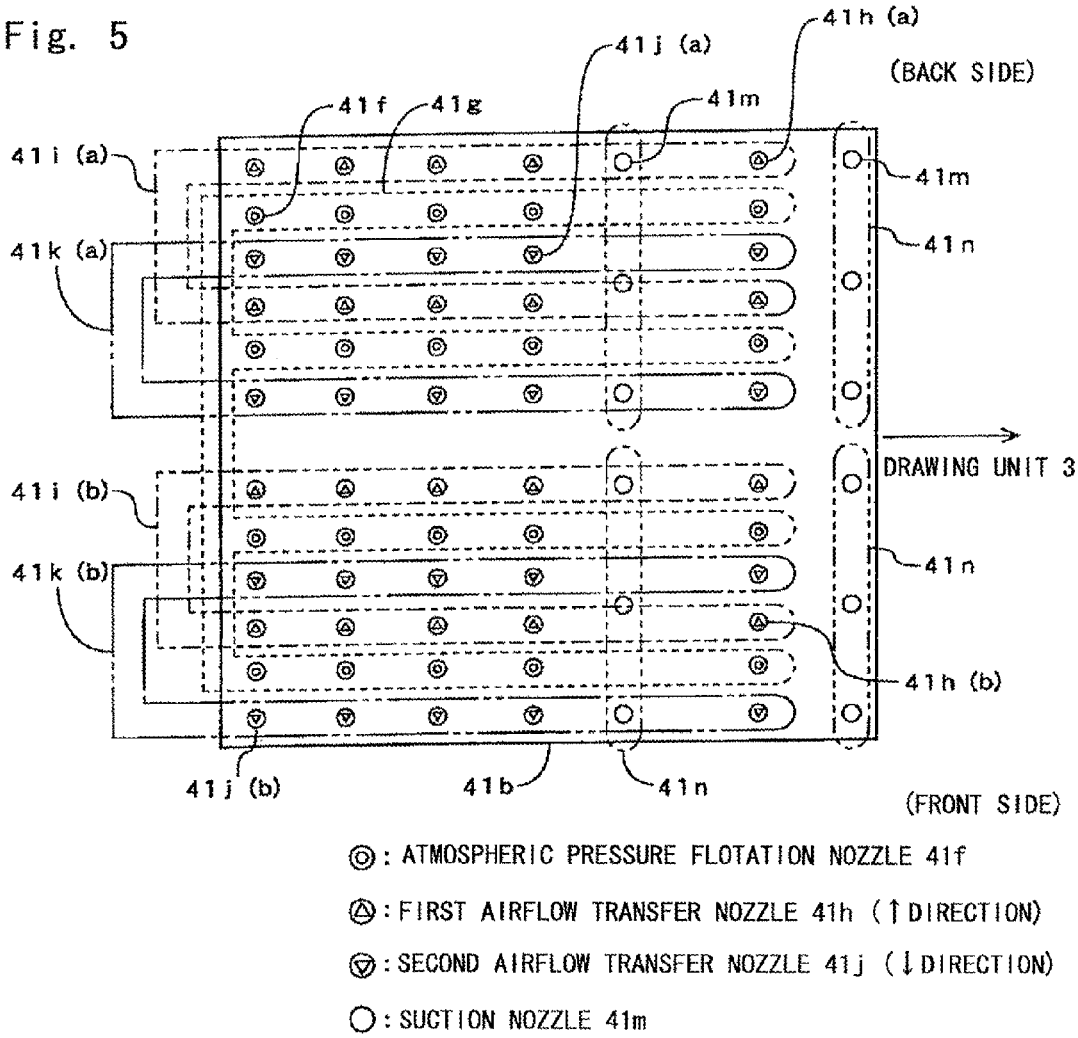
FIG. 5 is a top view showing a nozzle unit shown in FIG. 4.
Figure 6:
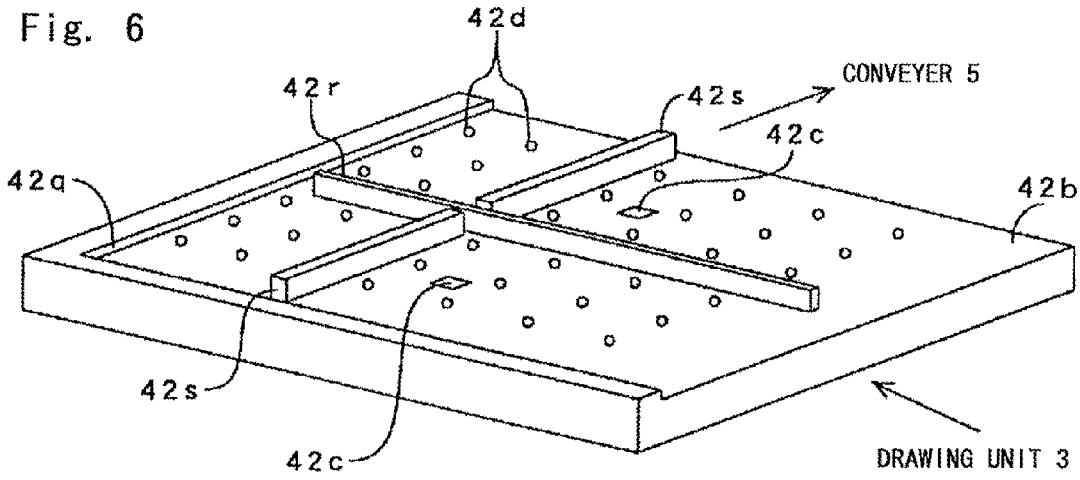
FIG. 6 is a perspective view showing a plate discharge table shown in FIG. 3.
Figure 7:
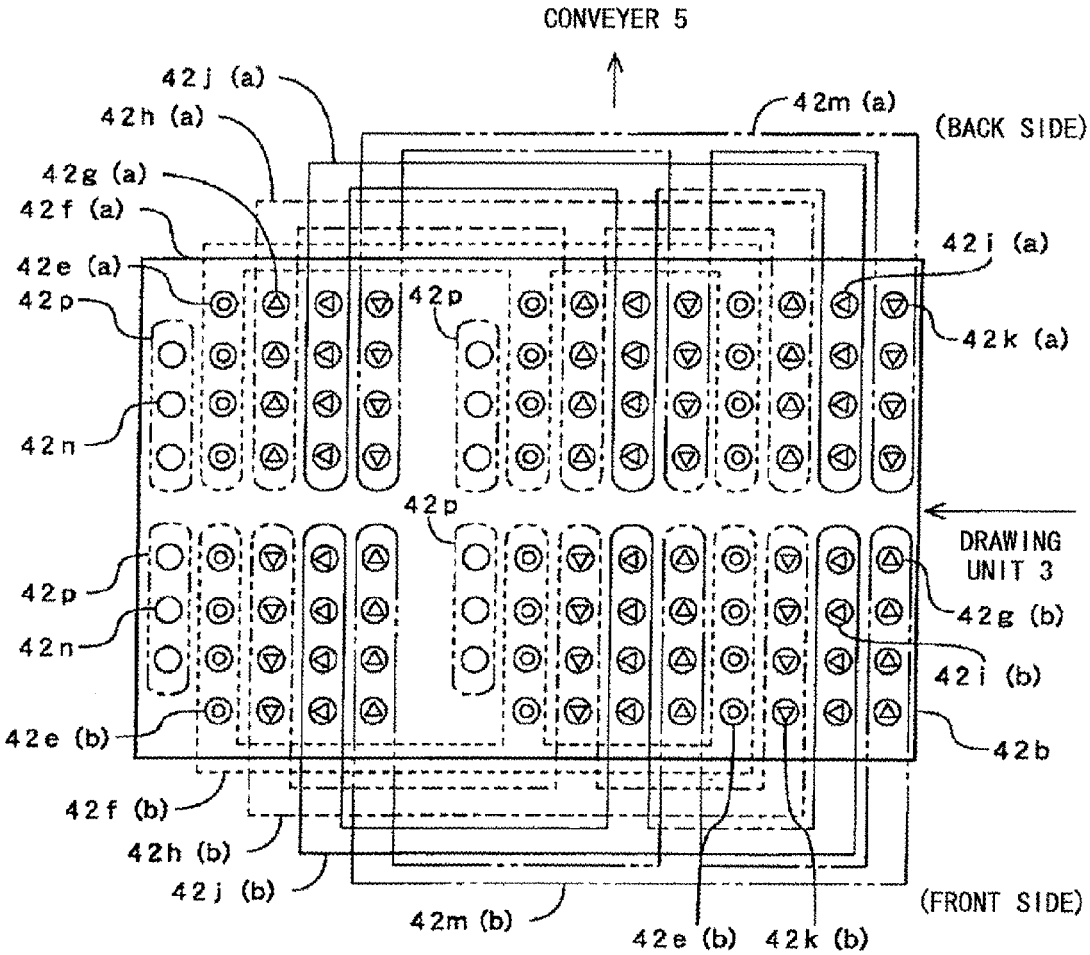
FIG. 7 is a top view showing a nozzle unit shown in FIG. 6.
Figure 8A:
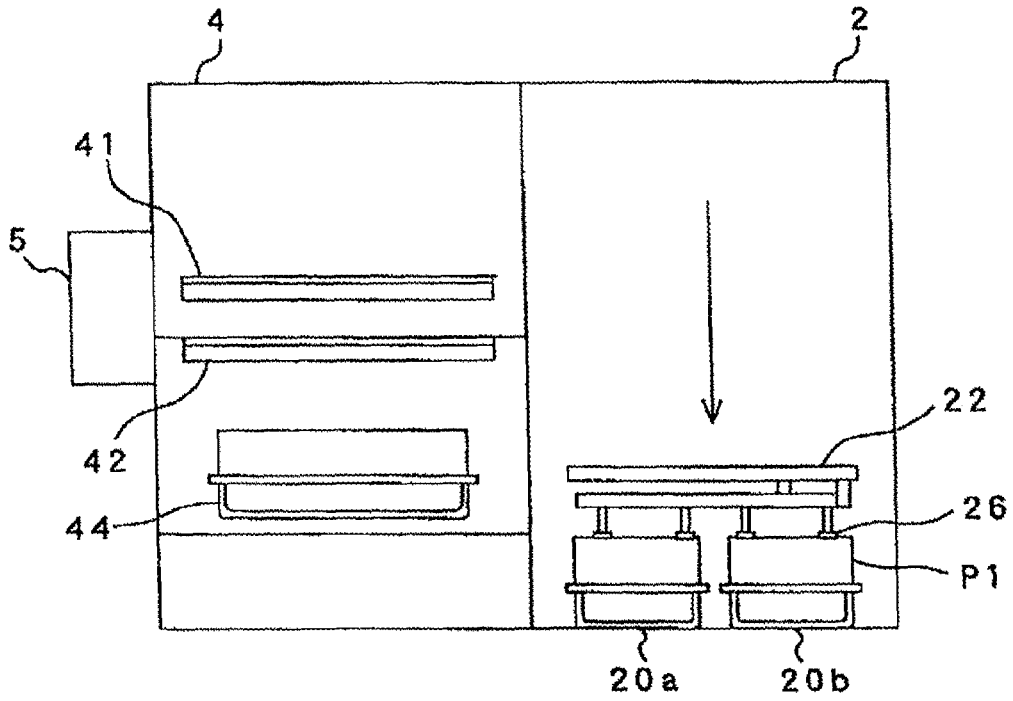
FIG. 8A is a schematic view showing a first step of a printing plate forming process.
Figure 8B:
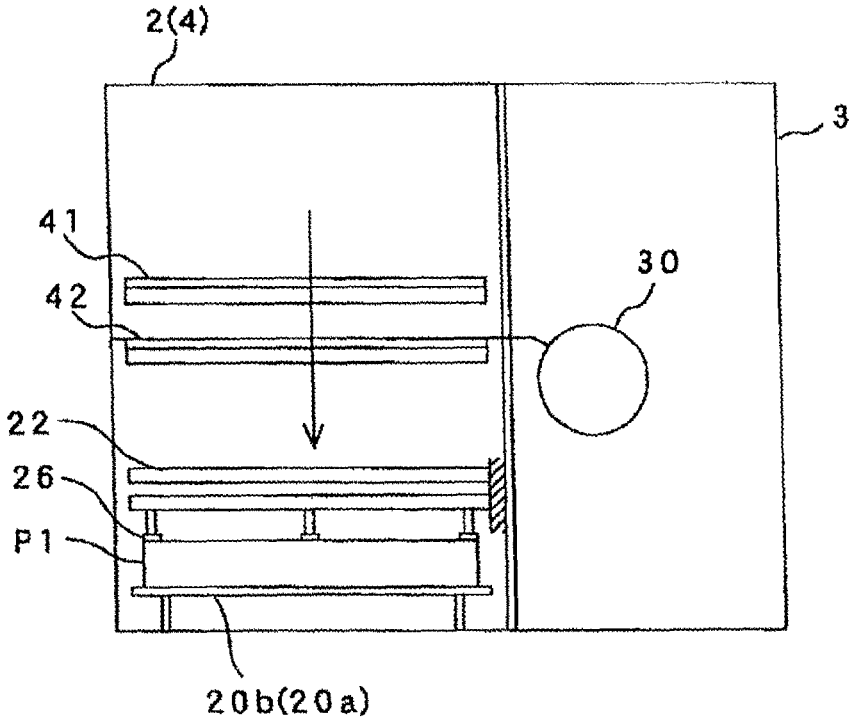
FIG. 8B is a schematic view showing the first step of the printing plate forming process.
Figure 10A:
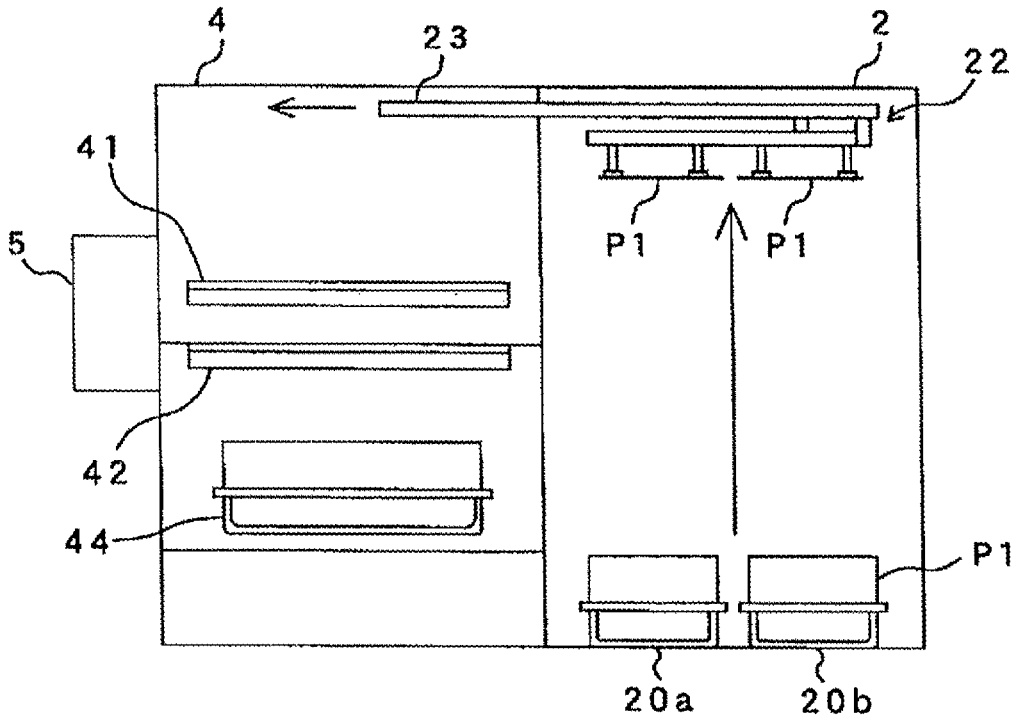
FIG. 10A is a schematic view showing a second step of the printing plate forming process.
Figure 10B:
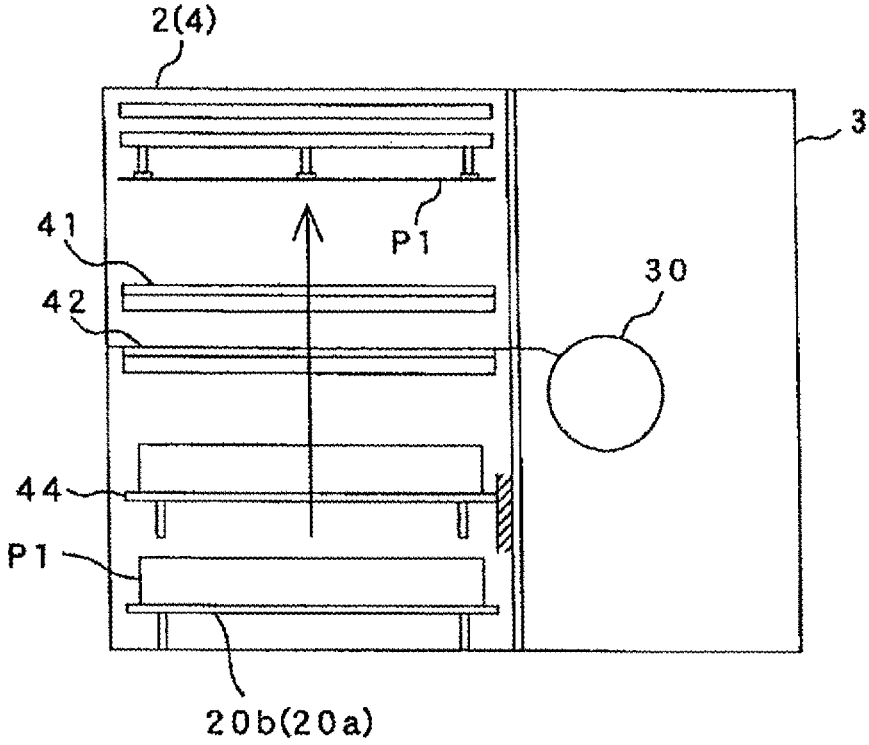
FIG. 10B is a schematic view showing the second step of the printing plate forming process.
Figure 11A:
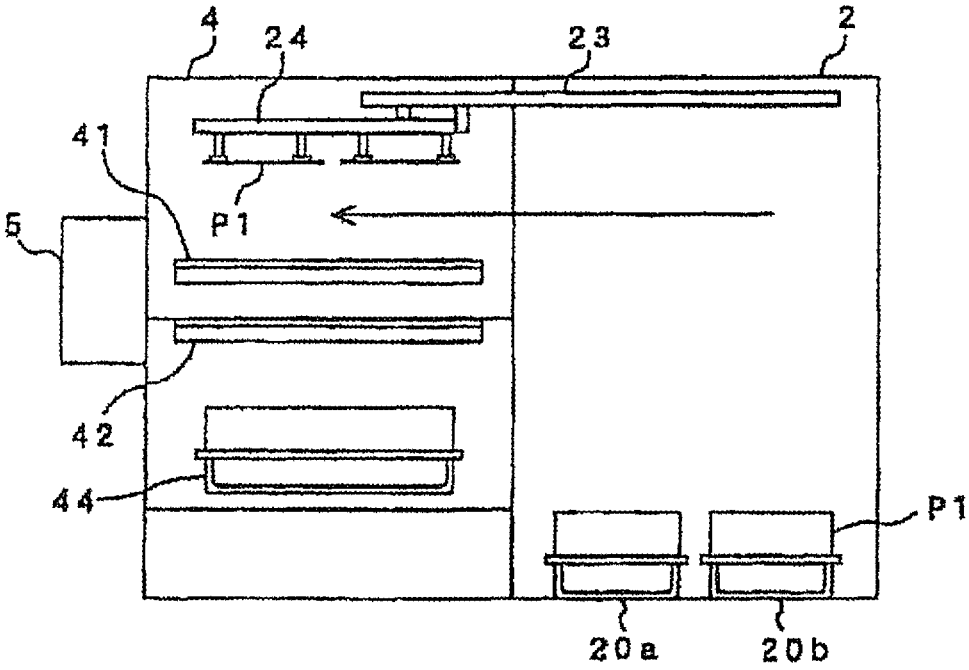
FIG. 11A is a schematic view showing a third step of the printing plate forming process.
Figure 11B:
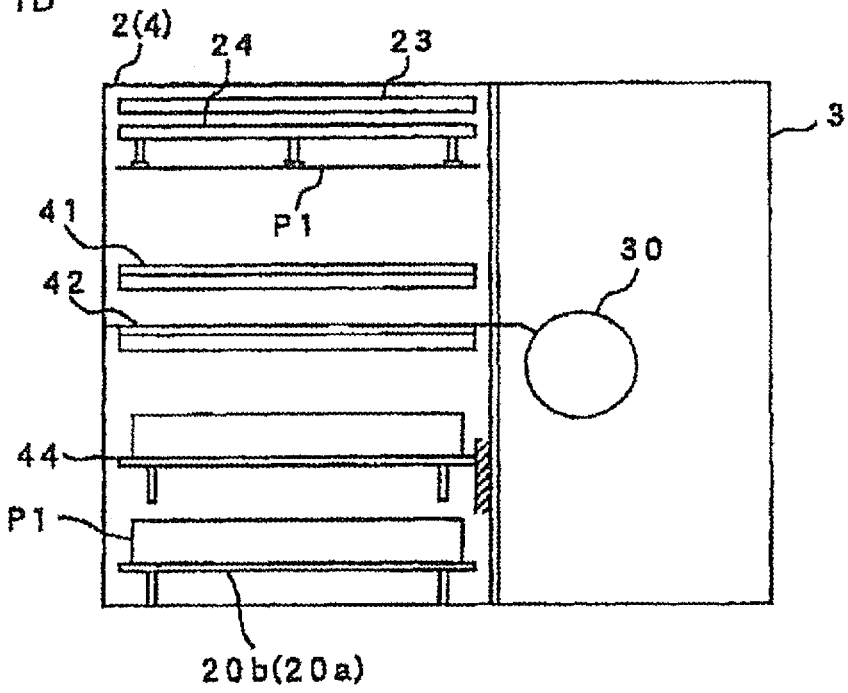
FIG. 11B is a schematic view showing the third step of the printing plate forming process.
Figure 12A:
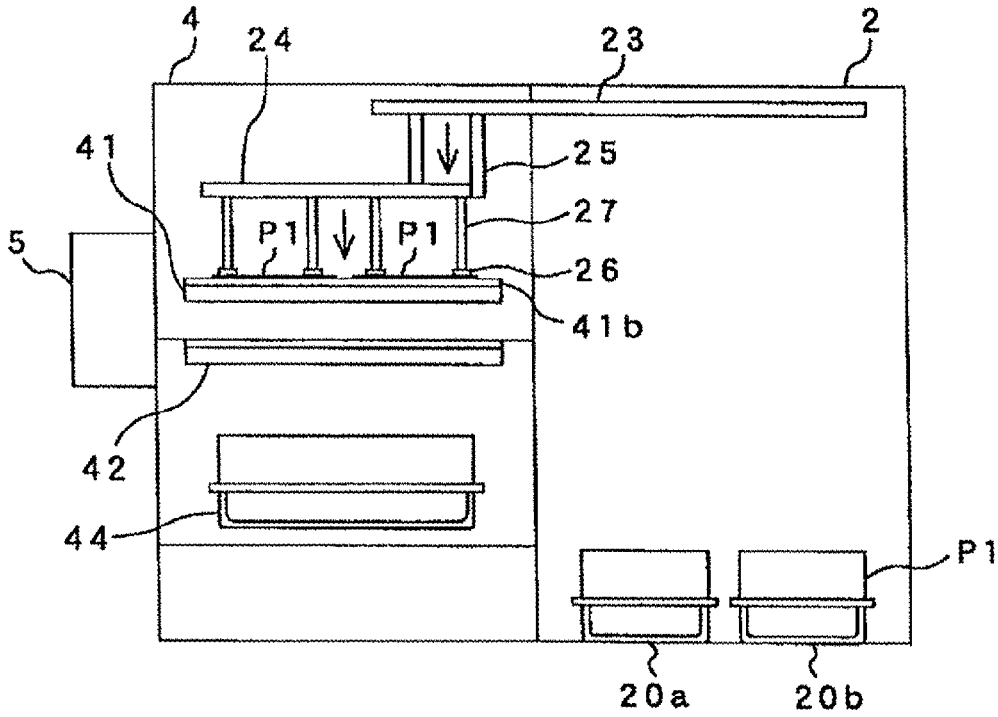
FIG. 12A is a schematic view showing a fourth step of the printing plate forming process.
Figure 12B:
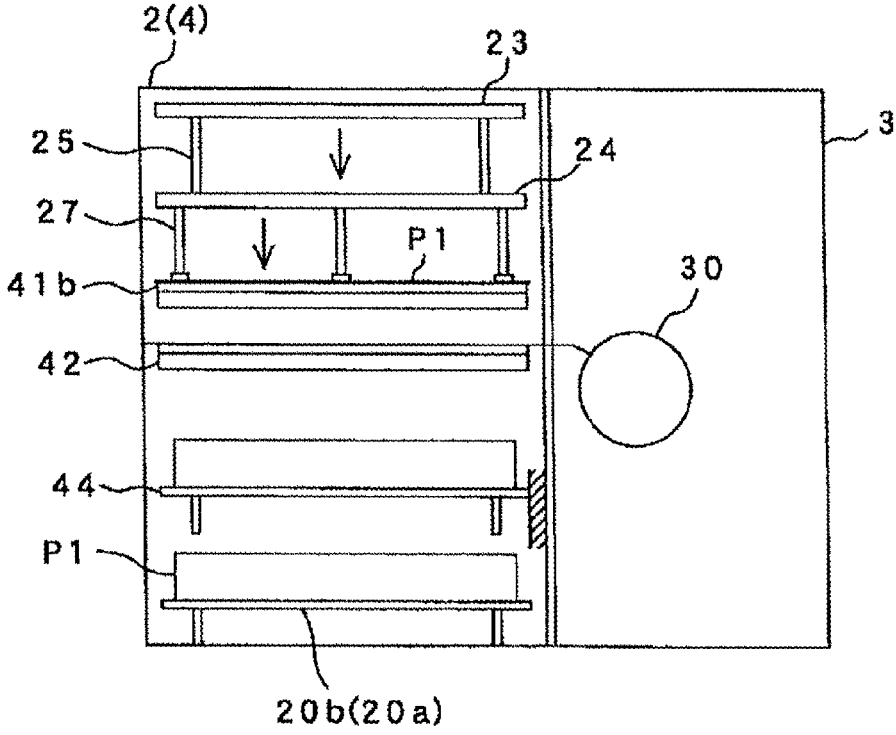
FIG. 12B is a schematic view showing the fourth step of the printing plate forming process.
Figure 13A:
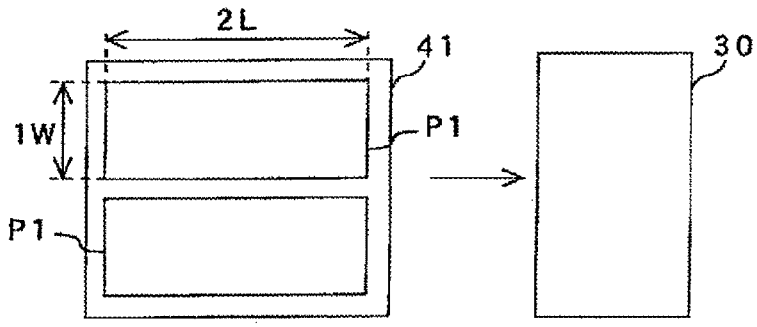
FIG. 13A is a view showing a placement state of plates.
Figure 13B:
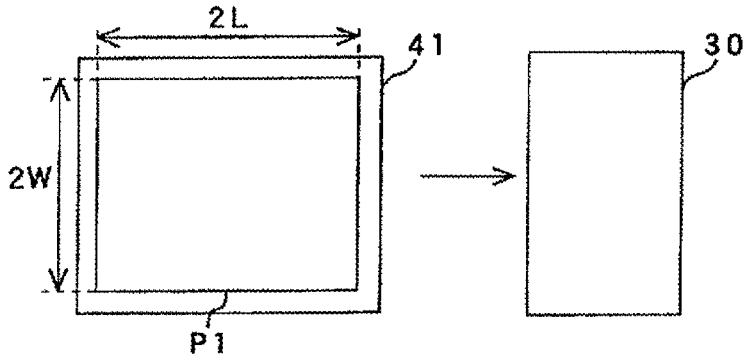
FIG. 13B is a view showing a placement state of a plate.
Figure 13C:
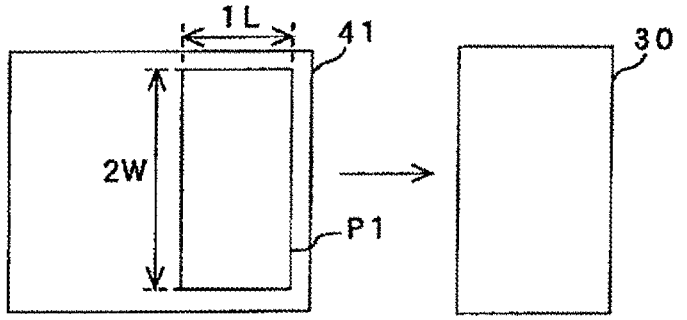
FIG. 13C is a view showing a placement state of a plate.
Figure 13D:
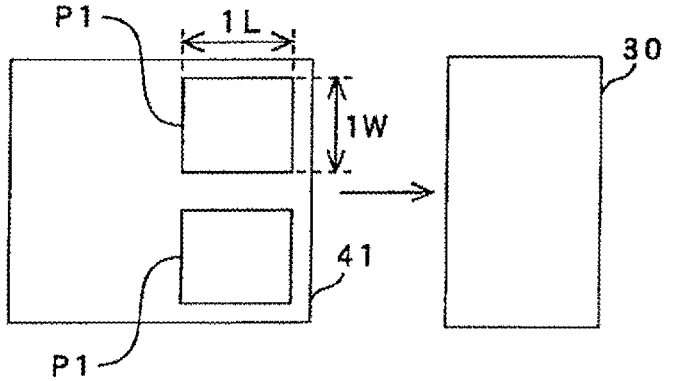
FIG. 13D is a view showing a placement state of plates.
Figure 14:
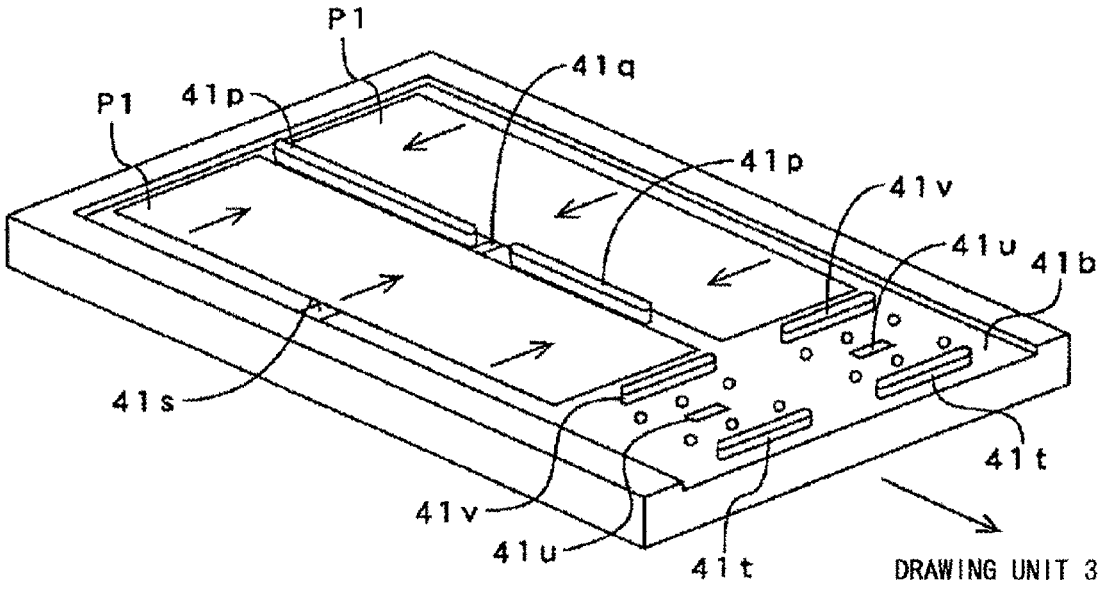
FIG. 14 is a view showing a positioning state of plates.
Figure 15A:
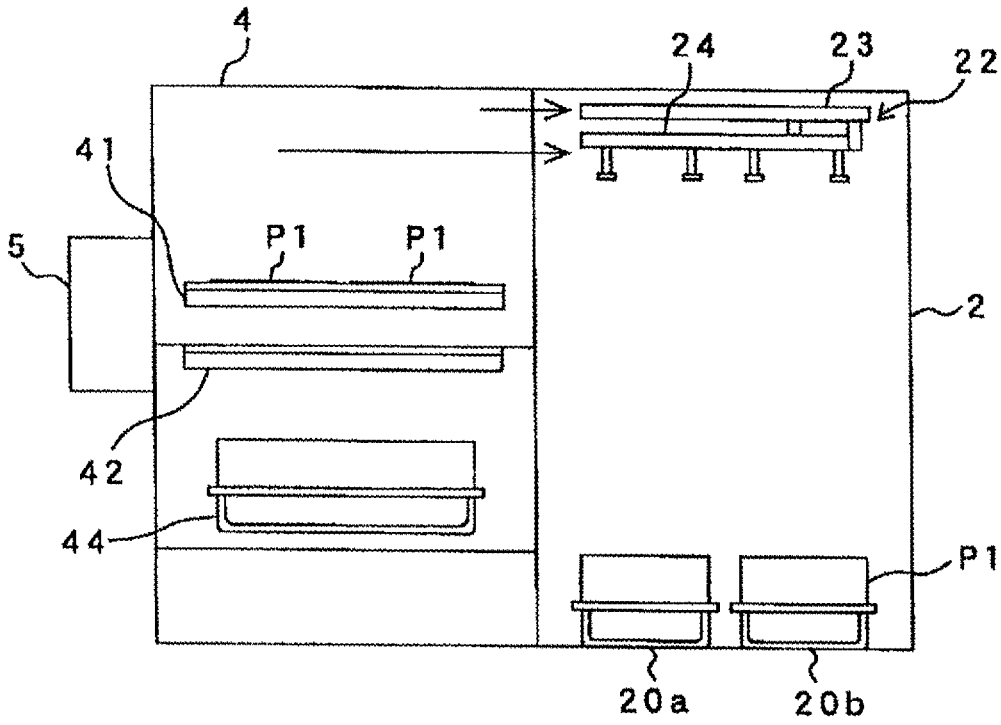
FIG. 15A is a schematic view showing a fifth step of the printing plate forming process.
Figure 15B:
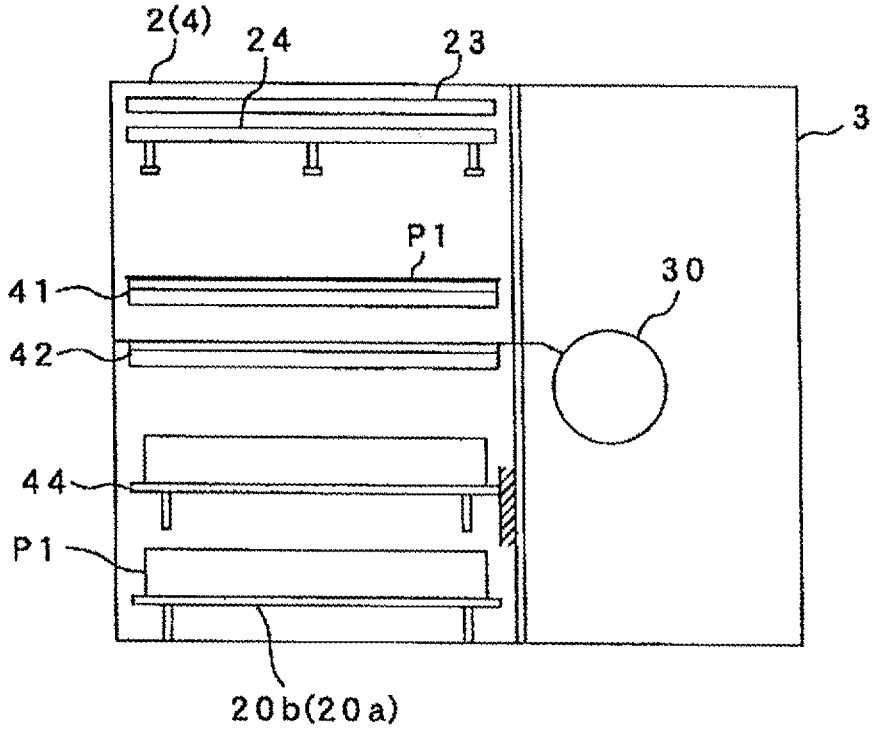
FIG. 15B is a schematic view showing the fifth step of the printing plate forming process.
Figure 16A:
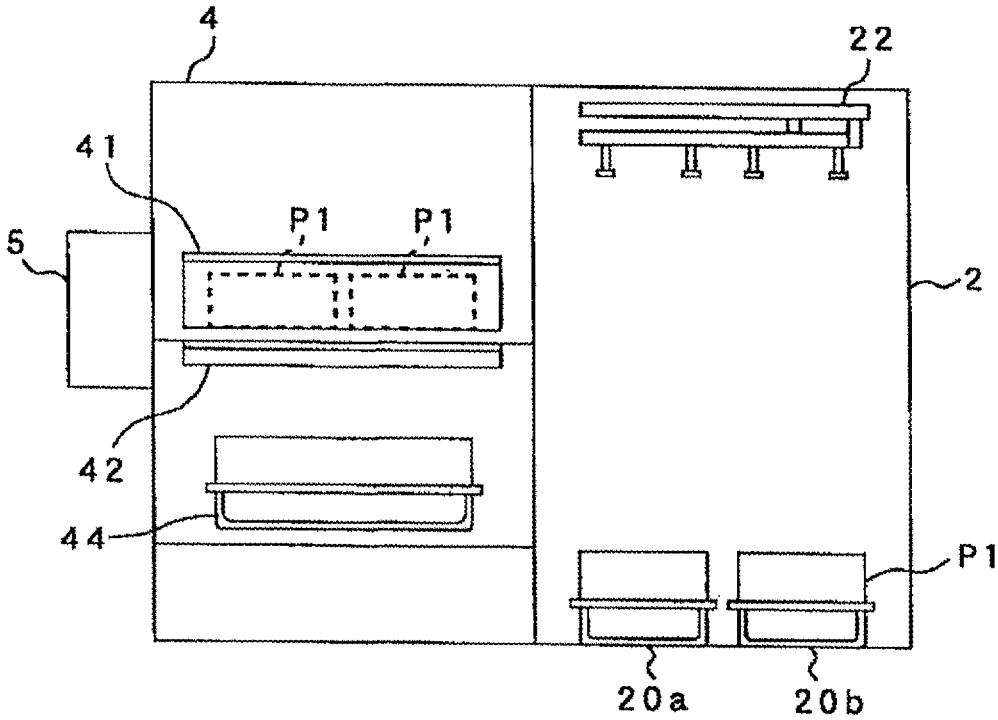
FIG. 16A is a schematic view showing a sixth step of the printing plate forming process.
Figure 16B:
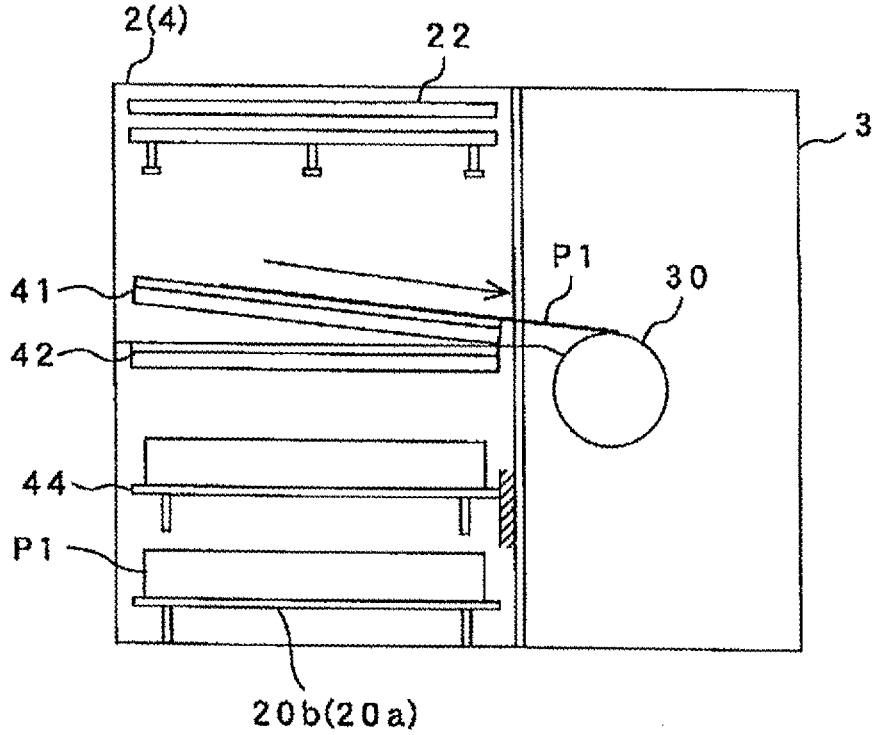
FIG. 16B is a schematic view showing the sixth step of the printing plate forming process.
Figure 17A:
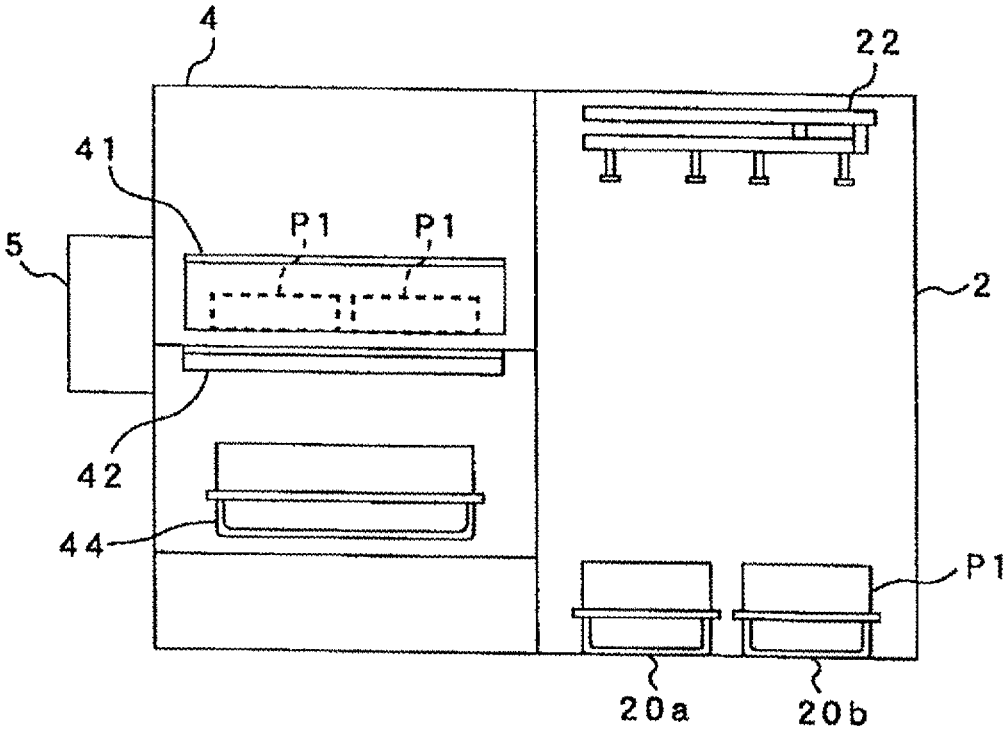
FIG. 17A is a schematic view showing a seventh step of the printing plate forming process.
Figure 17B:
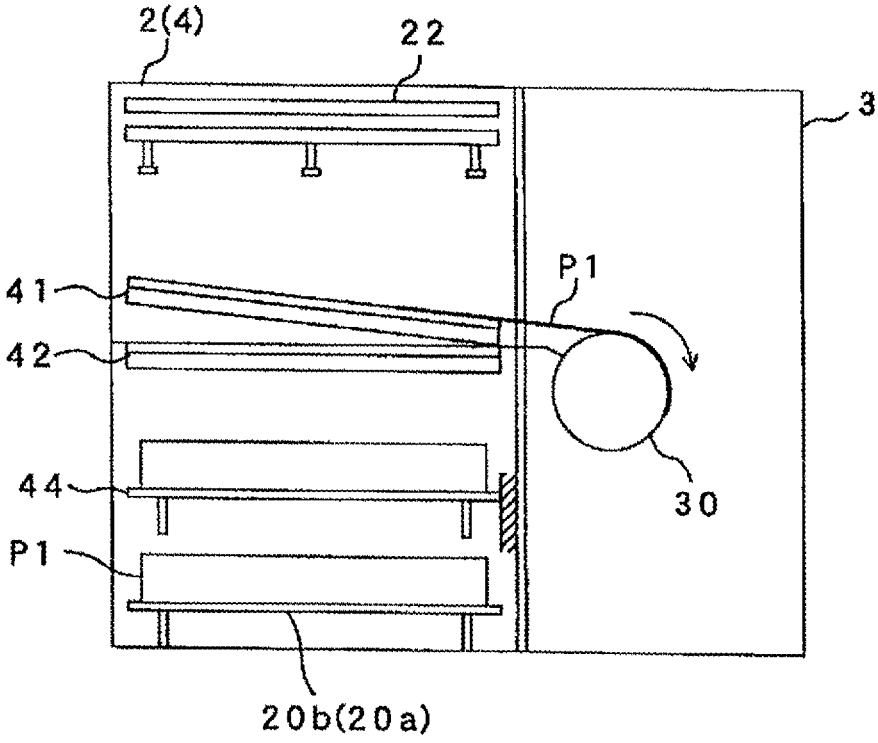
FIG. 17B is a schematic view showing the seventh step of the printing plate forming process.
Figure 18A:
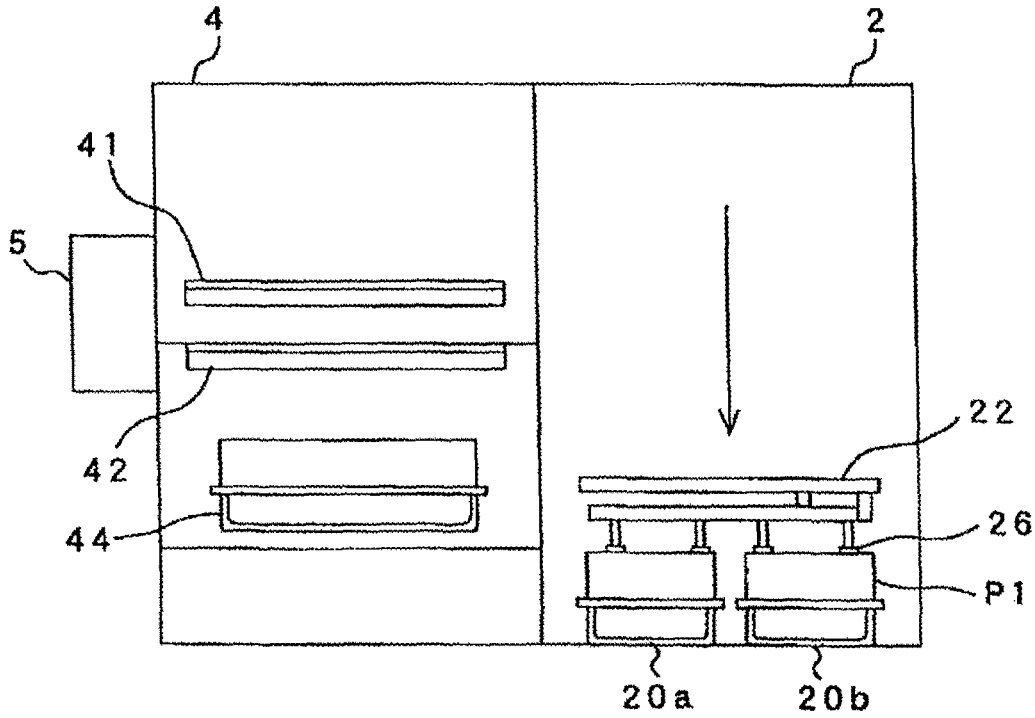
FIG. 18A is a schematic view showing an eighth step of the printing plate forming process.
Figure 18B:
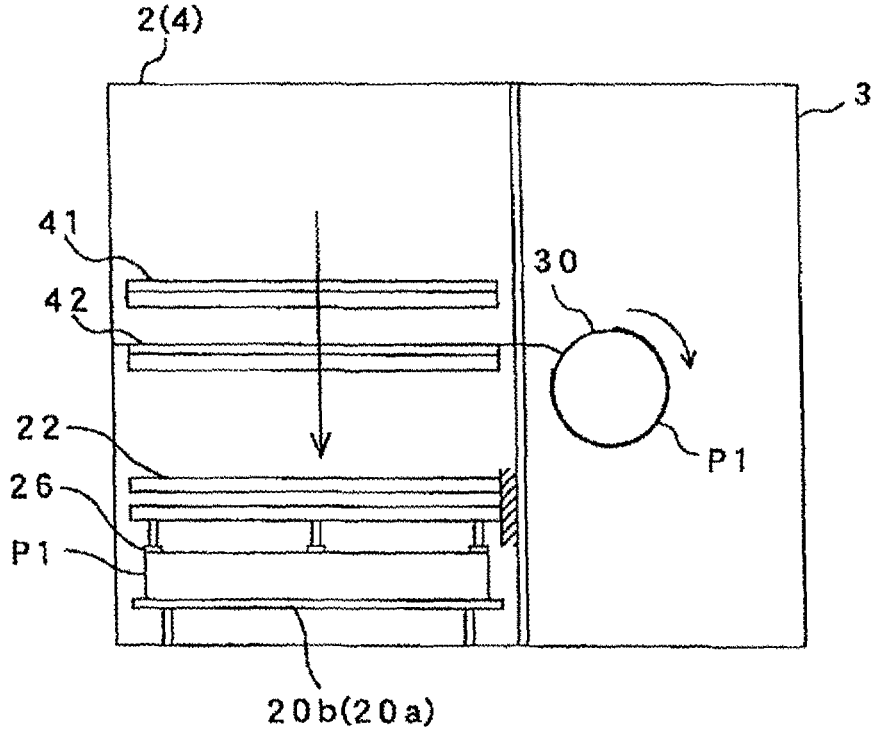
FIG. 18B is a schematic view showing the eighth step of the printing plate forming process.
Figure 19A:
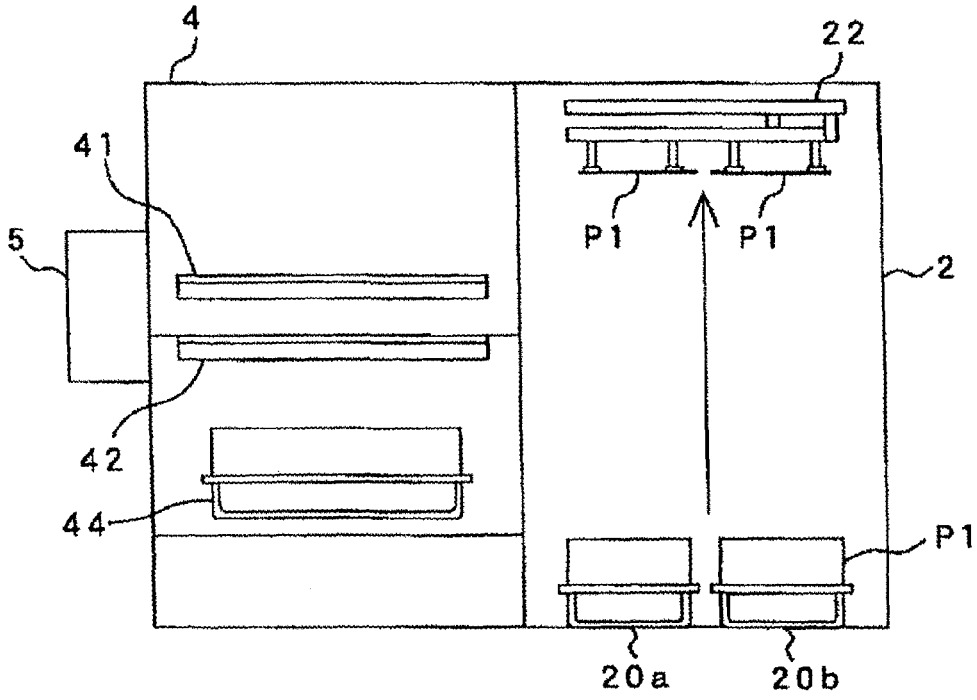
FIG. 19A is a schematic view showing a ninth step of the printing plate forming process.
Figure 19B:
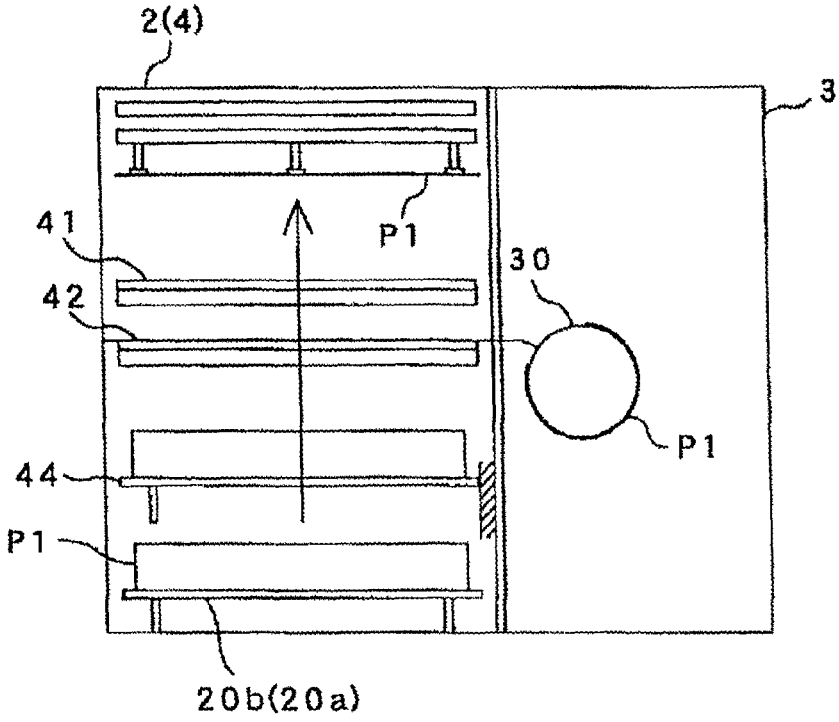
FIG. 19B is a schematic view showing the ninth step of the printing plate forming process.
Figure 20A:
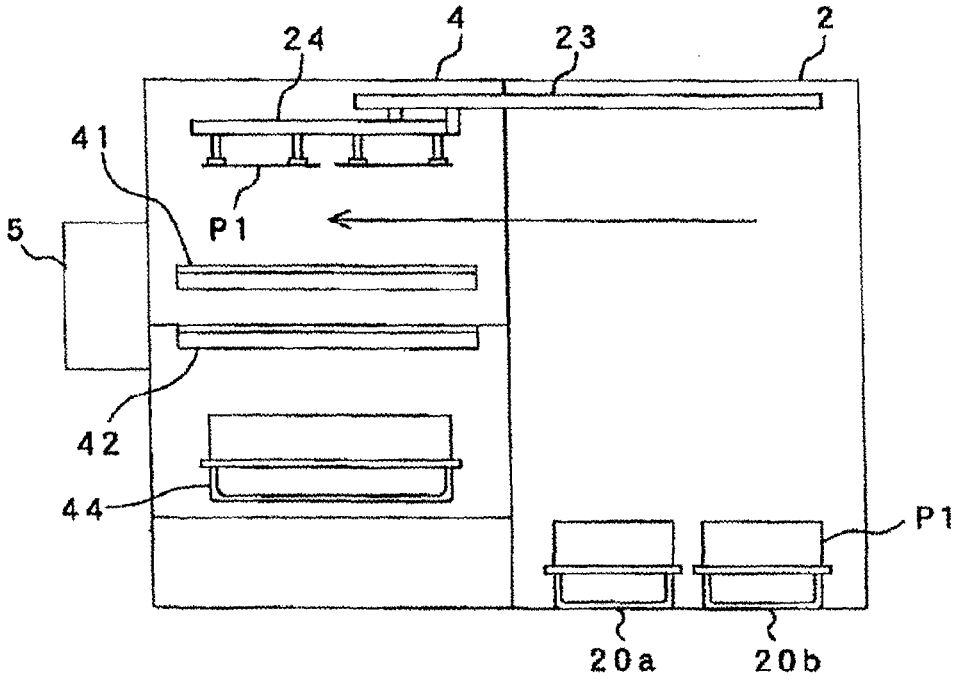
FIG. 20A is a schematic view showing a tenth step of the printing plate forming process.
Figure 20B:
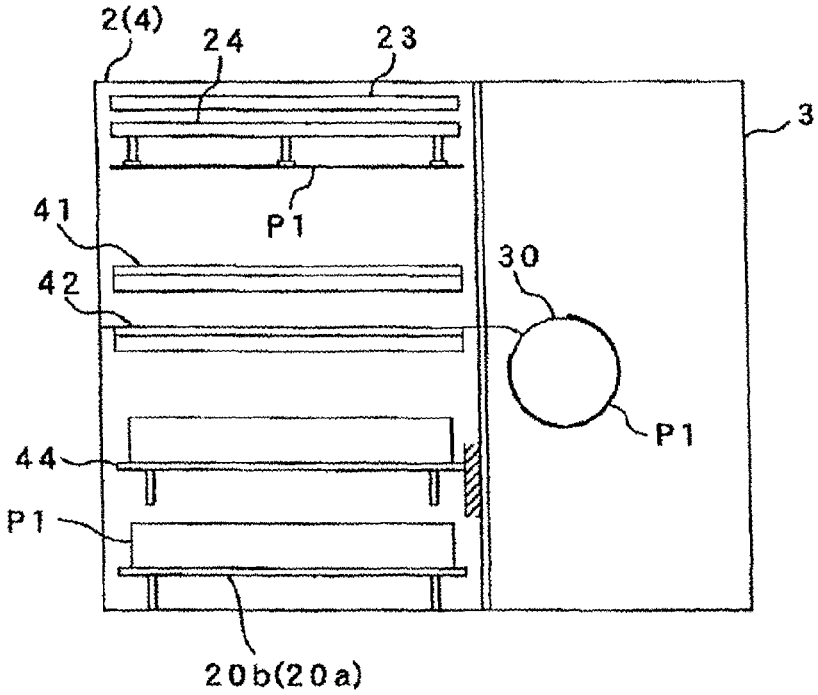
FIG. 20B is a schematic view showing the tenth step of the printing plate forming process.
Figure 21A:
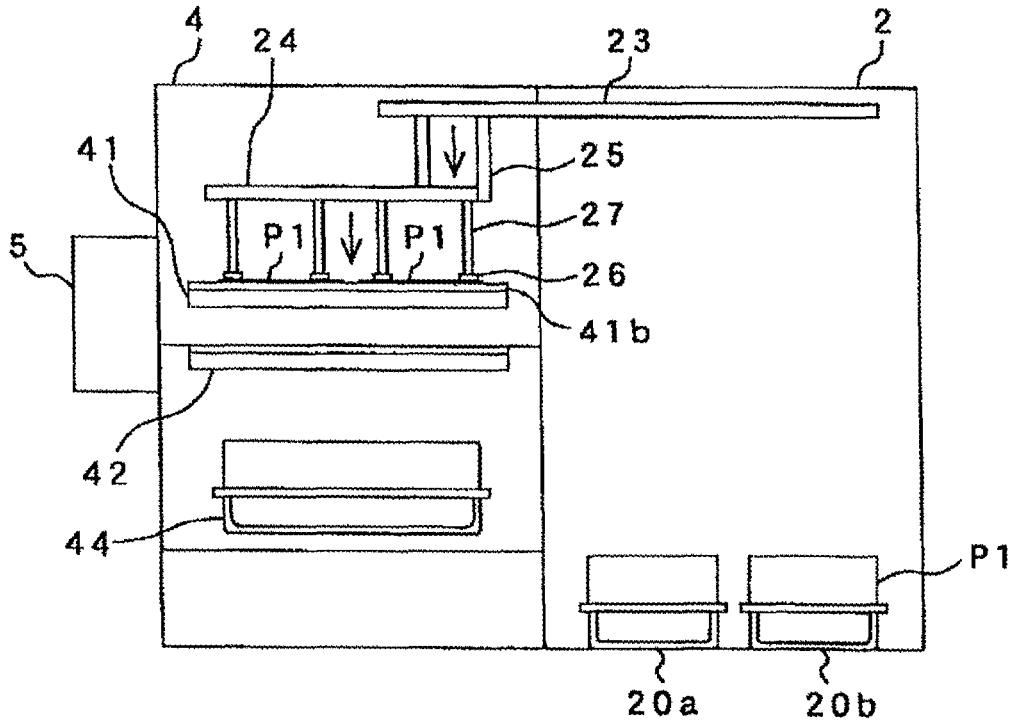
FIG. 21A is a schematic view showing an eleventh step of the printing plate forming process.
Figure 21B:
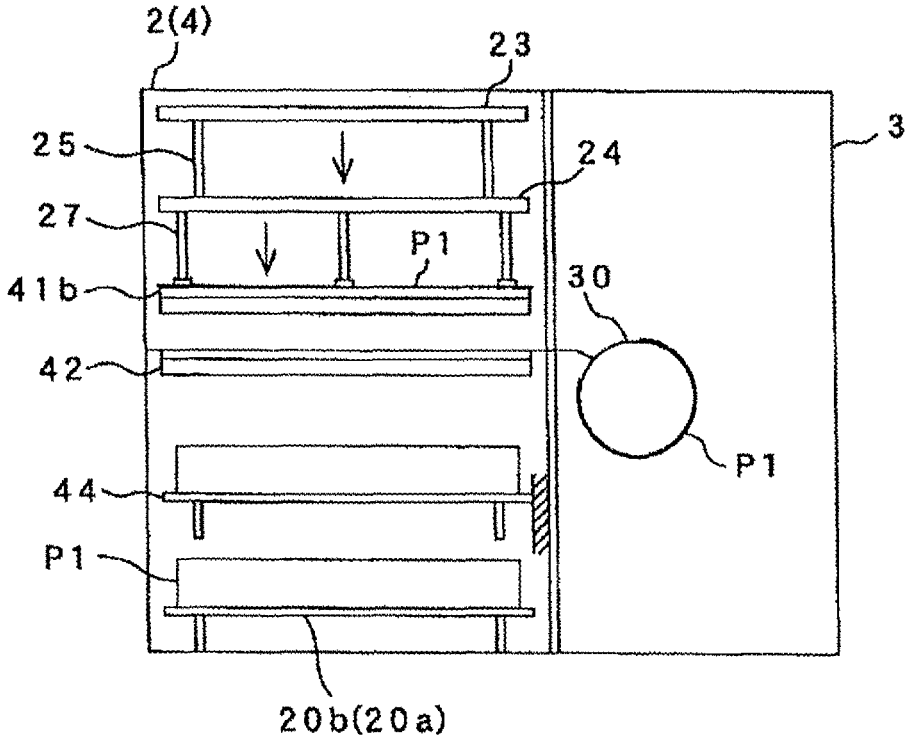
FIG. 21B is a schematic view showing the eleventh step of the printing plate forming process.
Figure 22A:
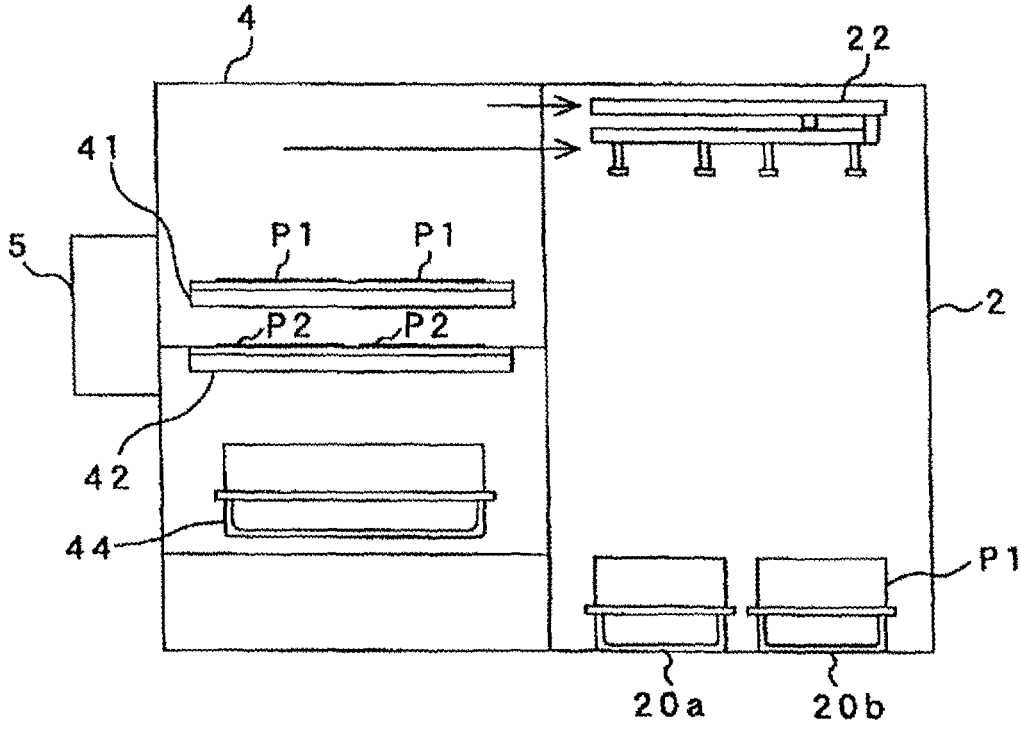
FIG. 22A is a schematic view showing a twelfth step of the printing plate forming process.
Figure 22B:
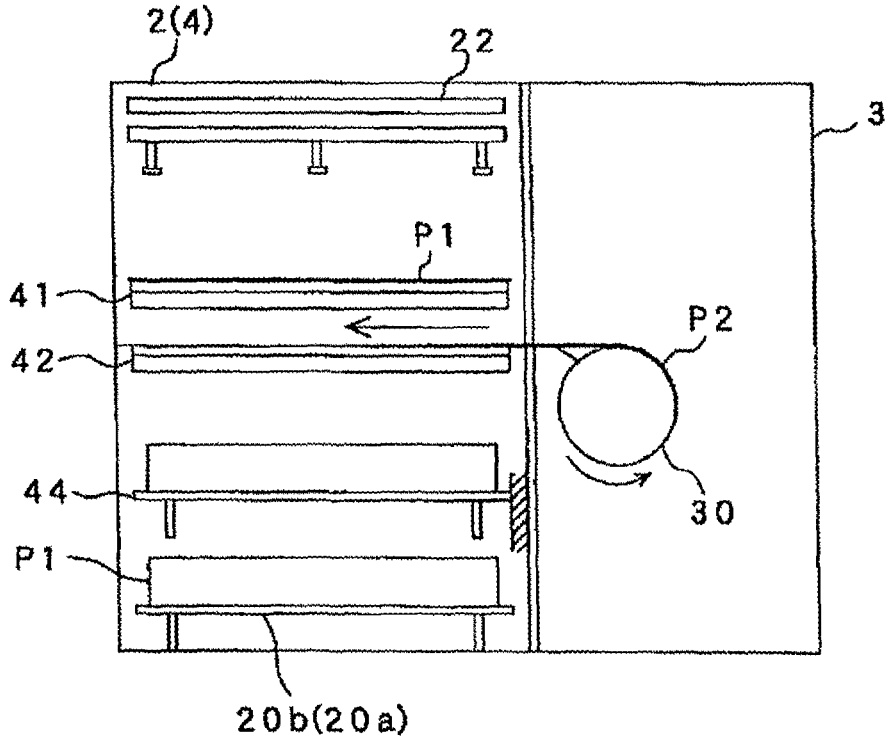
FIG. 22B is a schematic view showing the twelfth step of the printing plate forming process.
Figure 23:
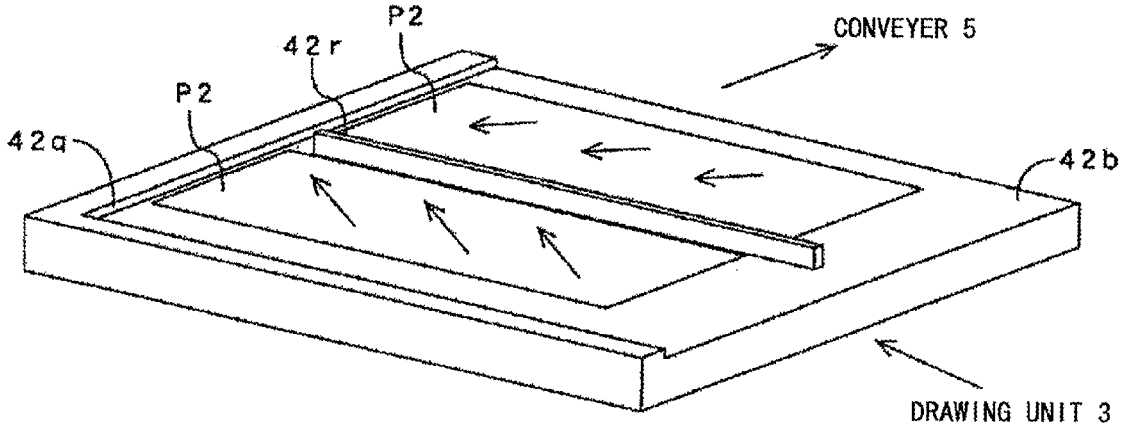
FIG. 23 is a view showing a positioning state of printing plates.
Figure 24A:
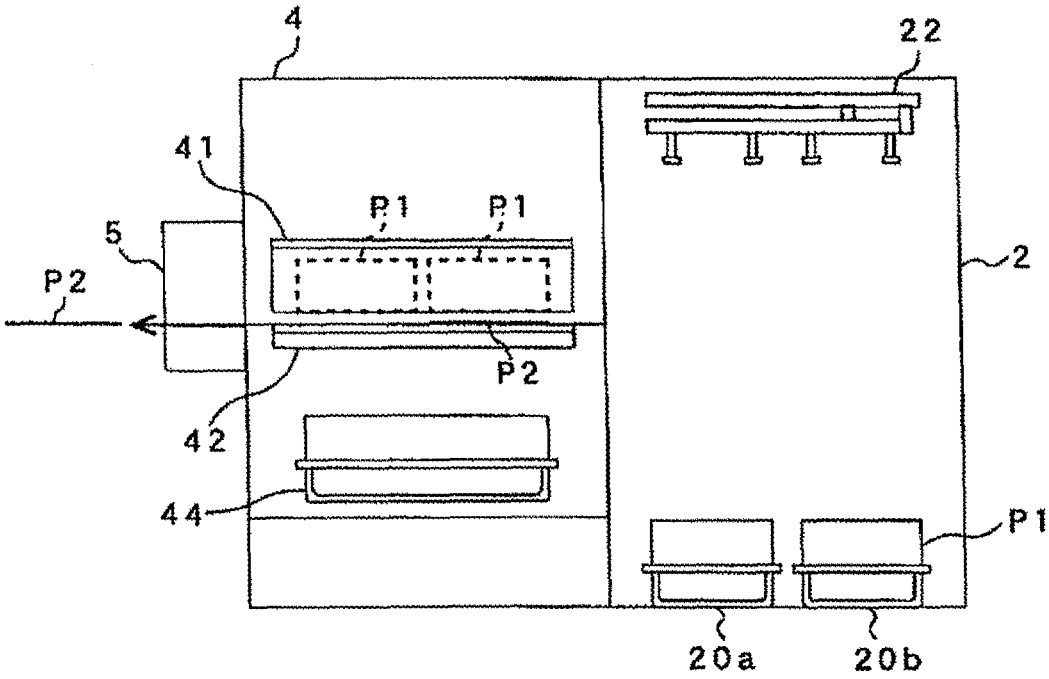
FIG. 24A is a schematic view showing a thirteenth step of the printing plate forming process.
Figure 24B:
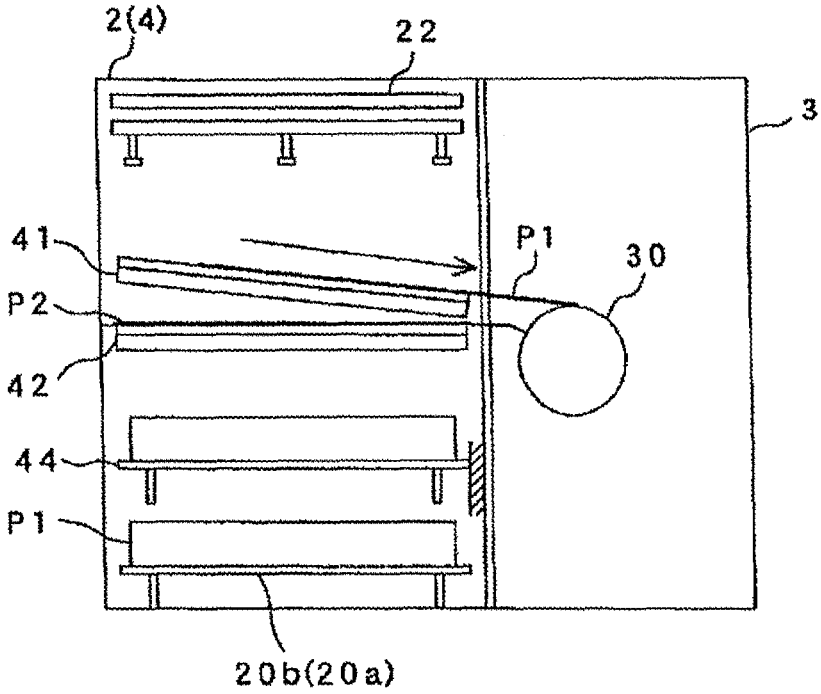
FIG. 24B is a schematic view showing the thirteenth step of the printing plate forming process.
Figure 25A:
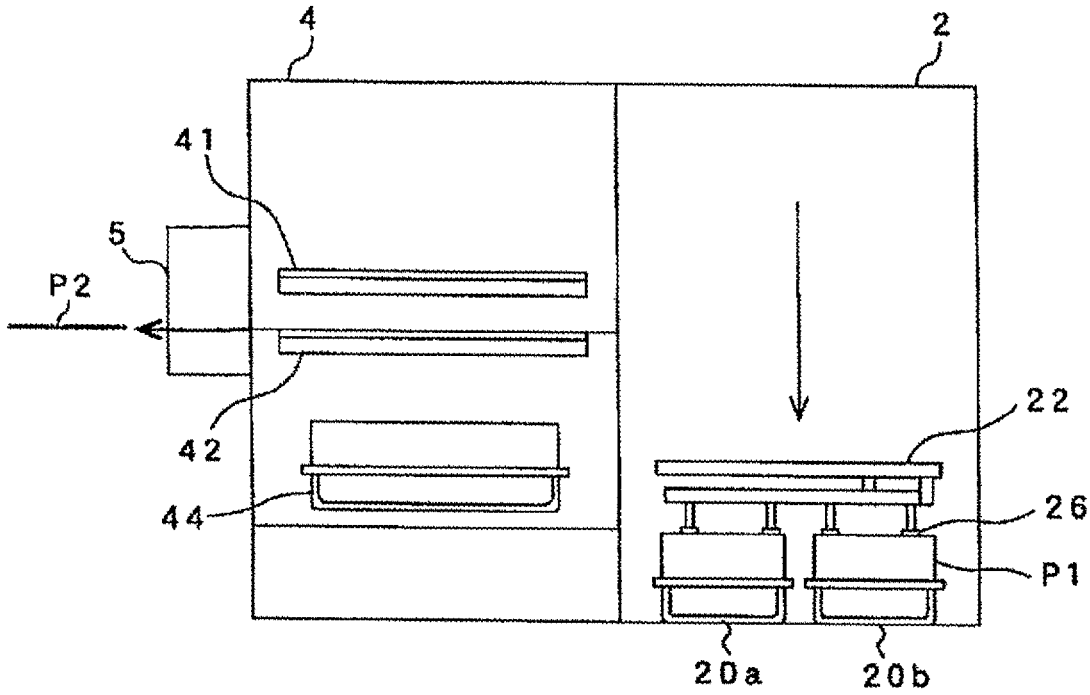
FIG. 25A is a schematic view showing a fourteenth step of the printing plate forming process.
Figure 25B:
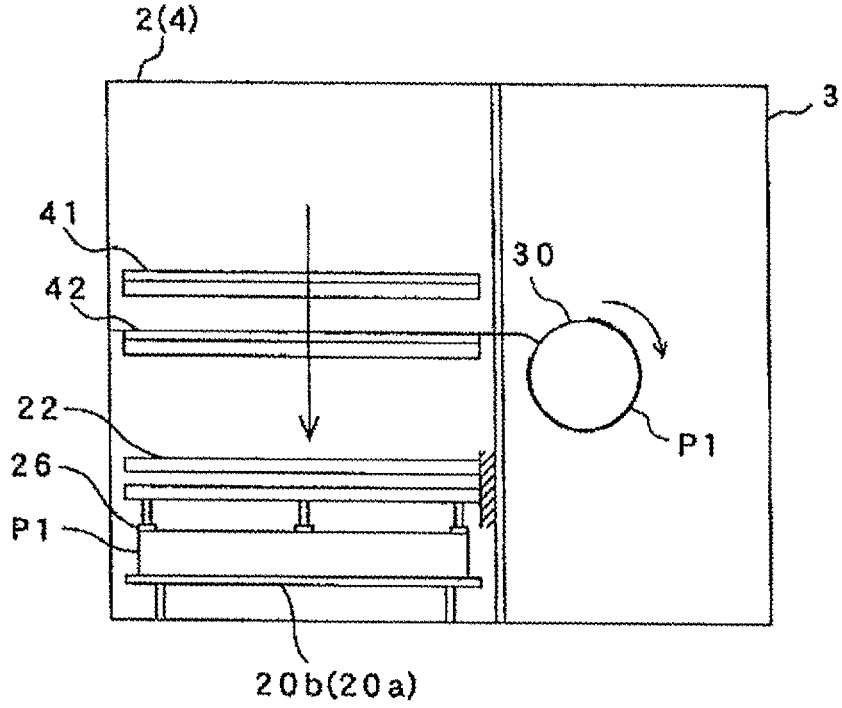
FIG. 25B is a schematic view showing the fourteenth step of the printing plate forming process.
Figure 26:
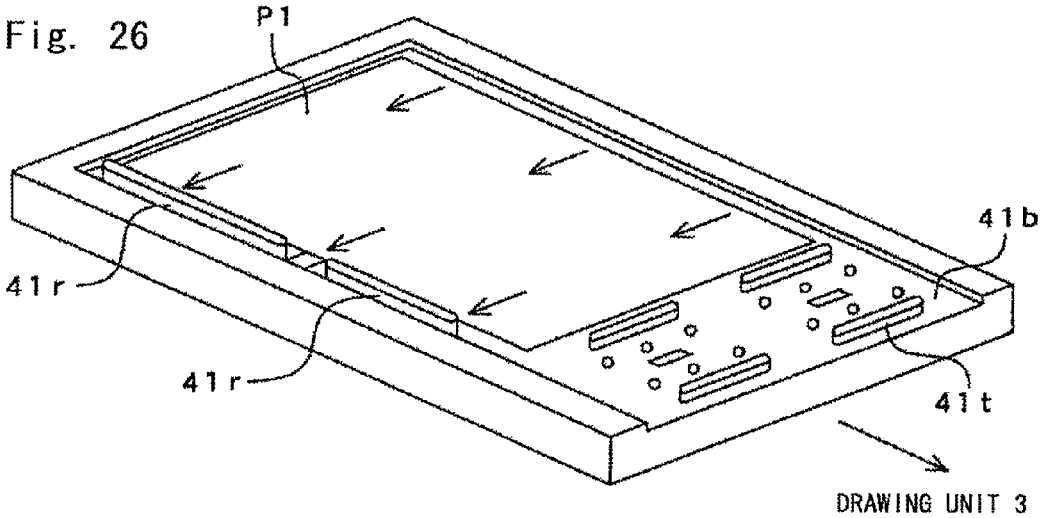
FIG. 26 is a view showing a positioning state of a 2W2L-size plate.
Figure 27:
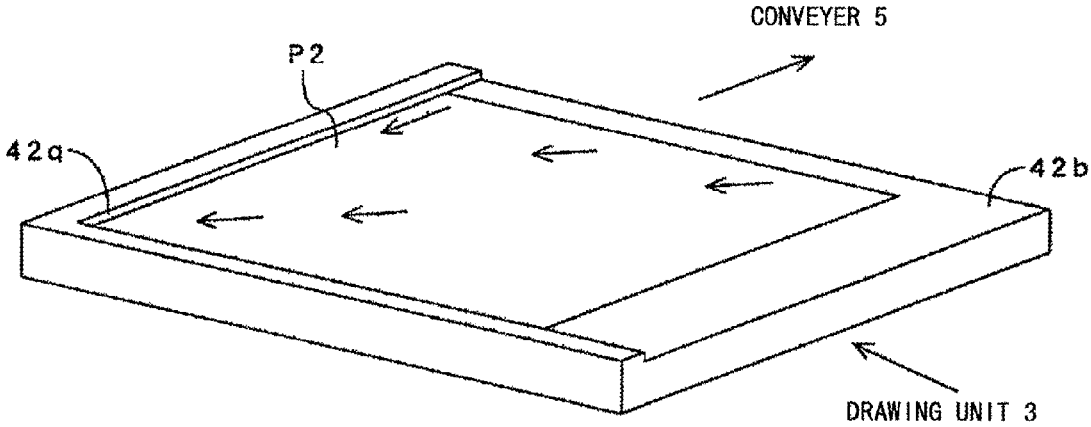
FIG. 27 is a view showing a positioning state of a 2W2L-size printing plate.
Figure 28:
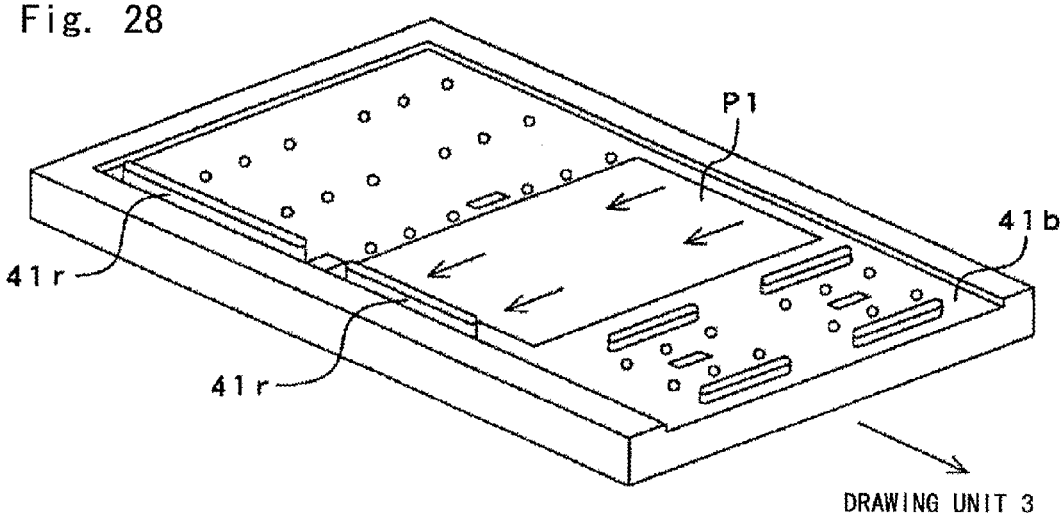
FIG. 28 is a view showing a positioning state of a 2W1L-size plate.
Figure 29:
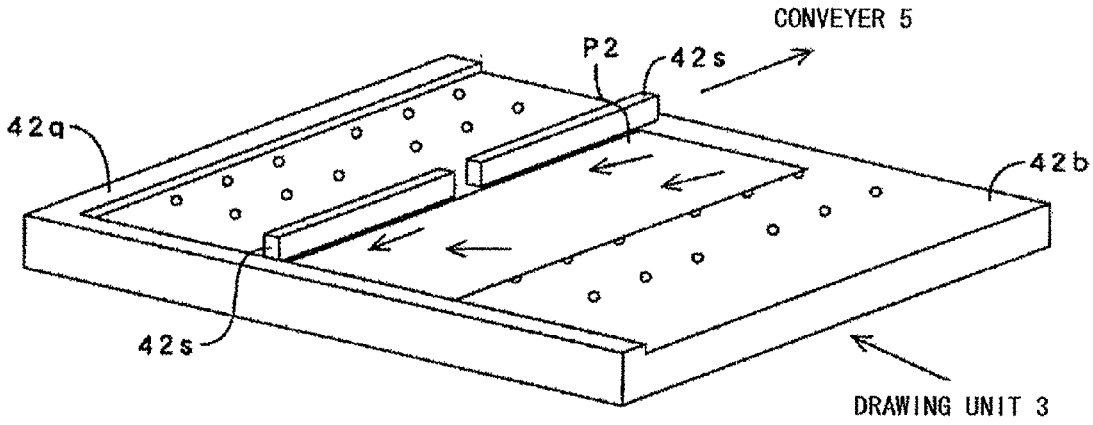
FIG. 29 is a view showing a positioning state of a 2W1L-size printing plate.
Figure 30:
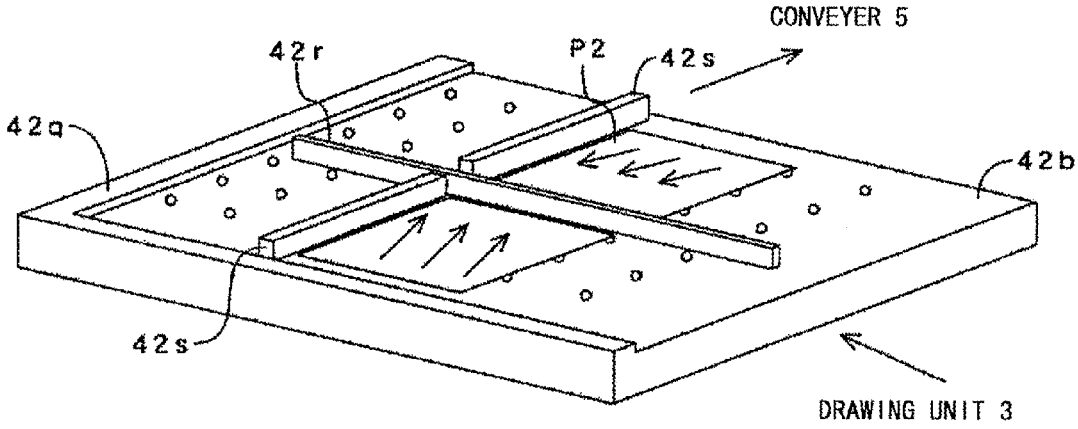
FIG. 30 is a view showing a positioning state of 1W1L-size printing plates.

1 PRINTING PLATE FORMING DEVICE
2 SKID STORAGE UNIT
3 DRAWING UNIT
4 PLATE SUPPLY AND DISCHARGE UNIT
5 CONVEYER
6 ELECTRICAL UNIT
20*a*, 20*b* SKID

21 PLACEMENT SECTION
22 EJECTION UNIT
23 GUIDE RAIL
24 EJECTION TABLE
25 FIRST ARM
26 SUCTION PAD
27 SECOND ARM
30 ROTARY DRUM
41 PLATE SUPPLY TABLE
41*a* TABLE BODY
41*b* TOP BOARD
41*c* TILT MECHANISM
41*d* PLATE DETECTION SENSOR
41*e* NOZZLE UNIT
41*f* ATMOSPHERIC PRESSURE FLOTATION NOZZLE
41*g* FIRST PIPE
41*h* FIRST AIRFLOW TRANSFER NOZZLE
41*i* SECOND PIPE
41*j* SECOND AIRFLOW TRANSFER NOZZLE
41*k* THIRD PIPE
41*m* SUCTION NOZZLE
41*n* FOURTH PIPE
41*p* FIRST POSITIONING GUIDE
41*q* FIRST POSITIONING SENSOR
41*r* SECOND POSITIONING GUIDE
41*s* SECOND POSITIONING SENSOR
41*t* PRE-INSERTION REFERENCE GUIDE
41*u* INSERTION POSITION DETERMINING SENSOR
41*v* ROCKABLE POSITIONING GUIDE
42 PLATE DISCHARGE TABLE
42*a* TABLE BODY
42*b* TOP BOARD
42*c* PLATE DETECTION SENSOR
42*d* NOZZLE UNIT
42*e* ATMOSPHERIC PRESSURE FLOTATION NOZZLE
42*f* FIFTH PIPE
42*g* THIRD AIRFLOW TRANSFER NOZZLE
42*h* SIXTH PIPE
42*i* FOURTH AIRFLOW TRANSFER NOZZLE
42*j* SEVENTH PIPE
42*k* FIFTH AIRFLOW TRANSFER NOZZLE
42*m* EIGHTH PIPE
42*n* SUCTION NOZZLE
42*p* NINTH PIPE
42*q* GUIDE BLOCK
42*r* THIRD POSITIONING GUIDE
41*s* FOURTH POSITIONING GUIDE
43 PLACEMENT SECTION
44 SKID
60 TOUCH PANEL
P1 PLATE
P2 PRINTING PLATE

The invention claimed is:

1. A plate supply and discharge device which supplies a plate to a drawing unit, receives a printing plate having an image drawn thereon from the drawing unit, and delivers the printing plate outside, the plate supply and discharge device comprising:

a plate supply table which includes: a first atmospheric pressure flotation unit that vertically directs a jet of air at the plate and allows the plate to float at atmospheric pressure; a first airflow transfer unit that obliquely directs a jet of air at the plate and transfers the plate at atmospheric pressure; and a plurality of plate positioning guides disposed at different positions depending on the size of the plate so as to correspond to one side among four sides of the plate;

a plate discharge table which includes: a second atmospheric pressure flotation unit that vertically directs a jet of air at the printing plate and allows the printing plate to float at atmospheric pressure; a second airflow transfer unit that obliquely directs a jet of air at the printing plate and transfers the printing plate at atmospheric pressure; and a plurality of printing plate positioning guides disposed at different positions depending on the size of the printing plate so as to correspond to one side among four sides of the printing plate, wherein the plate in a state of being allowed to float at atmospheric pressure is moved above the plate supply table and supplied to the drawing unit, and the printing plate in a state of being allowed to float at atmospheric pressure is moved above the plate discharge table and delivered outside.

2. The plate supply and discharge device according to claim 1, wherein the plate supply table comprises a first plate detection sensor that detects presence or absence of the plate.

3. The plate supply and discharge device according to claim 1, wherein the plate discharge table comprises a second plate detection sensor that detects presence or absence of the printing plate.

4. The plate supply and discharge device according to claim 1, wherein the first airflow transfer unit includes two or more types of air blowing units having different air blowing directions.

5. The plate supply and discharge device according to claim 1, wherein in at least one of the first atmospheric pressure flotation unit and the first airflow transfer unit, a plurality of air blowing units having the same air blowing direction is disposed on a single pipe.

6. The plate supply and discharge device according to claim 1, wherein the plate is transferred by airflow toward the plate positioning guides on the plate supply table, and the plate is positioned by being aligned to the plate positioning guides on the plate supply table.

7. The plate supply and discharge device according to claim 6, wherein the plurality of plate positioning guides on the plate supply table are structured to be movable on the surface of the supply table and movable in and out thereof.

8. The plate supply and discharge device according to claim 1, wherein the second airflow transfer unit includes two or more types of air blowing units having different air blowing directions.

9. The plate supply and discharge device according to claim 1, wherein in at least one of the second atmospheric pressure flotation unit and the second airflow transfer unit, a plurality of air blowing units having the same air blowing direction is disposed on a single pipe.

10. The plate supply and discharge device according to claim 1, wherein the printing plate is transferred by airflow toward the printing plate positioning guides on the plate discharge table, and the printing plate is positioned by being aligned to the printing plate positioning guides on the plate discharge table.

11. The plate supply and discharge device according to claim 10, wherein the plurality of printing plate positioning guides on the slate discharge table are structured to be movable on the surface of the discharge table and movable in and out thereof.

12. The plate supply and discharge device according to claim 1, wherein the plate supply table is structured to be tiltable.

13. The plate supply and discharge device according to claim 1, wherein the plate supply table and the plate discharge table are vertically disposed in multiple stages.

14. The plate supply and discharge device according to claim 1, further comprising a plate ejection unit that ejects the plate from a storage section for storing the plate and transfers the plate onto the supply table, wherein the plate ejection unit ejects a subsequent plate from the storage section and transfers the subsequent plate onto the supply table during a time when an image is drawn on the plate in the drawing unit.

15. A plate supply and discharge device which supplies a plate to a drawing unit, receives a printing plate having an image drawn thereon from the drawing unit, and delivers the printing plate outside, the plate supply and discharge device comprising:

a plate supply table which includes: a first atmospheric pressure flotation means that vertically directs a jet of air at the plate and allows the plate to float at atmospheric pressure; a first airflow transfer means that obliquely directs a jet of air at the plate and transfers the plate at atmospheric pressure; and a plurality of plate positioning guides disposed at different positions depending on the size of the plate so as to correspond to one side among four sides of the plate;

a plate discharge table which includes: a second atmospheric pressure flotation means that vertically directs a jet of air at the printing plate and allows the printing plate to float at atmospheric pressure; a second airflow transfer means that obliquely directs a jet of air at the printing plate and transfers the printing plate at atmospheric pressure; and a plurality of printing plate positioning guides disposed at different positions depending on the size of the printing plate so as to correspond to one side among four sides of the printing plate; wherein the plate in a state of being allowed to float at atmospheric pressure is moved above the plate supply table and supplied to the drawing unit, and the printing plate in a state of being allowed to float at atmospheric pressure is moved above the plate discharge table and delivered outside.

* * * * *